US008467920B2

(12) United States Patent
Asuka et al.

(10) Patent No.: US 8,467,920 B2
(45) Date of Patent: Jun. 18, 2013

(54) TRAIN CONTROL SYSTEM

(75) Inventors: Masashi Asuka, Tokyo (JP); Kenji Kataoka, Tokyo (JP); Koki Yoshimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 325 days.

(21) Appl. No.: 13/002,843

(22) PCT Filed: Apr. 13, 2009

(86) PCT No.: PCT/JP2009/001692

§ 371 (c)(1),
(2), (4) Date: Jan. 6, 2011

(87) PCT Pub. No.: WO2010/004673

PCT Pub. Date: Jan. 14, 2010

(65) Prior Publication Data

US 2011/0108677 A1 May 12, 2011

(30) Foreign Application Priority Data

Jul. 11, 2008 (JP) ..... 2008-181241

(51) Int. Cl.
*G05D 1/00* (2006.01)
*G05D 1/0077* (2006.01)
*G08G 1/017* (2006.01)

(52) U.S. Cl.
USPC ..... 701/19; 701/20; 246/167 D

(58) Field of Classification Search
None
See application file for complete search history.

(56) References Cited

U.S. PATENT DOCUMENTS 5,420,883 A * 5/1995 Swensen et al. ..... 375/138
5,437,422 A * 8/1995 Newman ..... 246/5

(Continued)

FOREIGN PATENT DOCUMENTS

JP 2 109770 4/1990
JP 8 207769 8/1996

(Continued)

OTHER PUBLICATIONS

International Search Report issued May 19, 2009 in PCT/JP09/001692 filed Apr. 13, 2009.
"Railroad Information Processing Technologies Contributing to Safety and Stability", IPSJ Magazine, vol. 48 No. 8, pp. 864-869 (Aug. 2007)(with Partial English Translation).

(Continued)

*Primary Examiner* — John Q Nguyen
*Assistant Examiner* — Edward Torchinsky
(74) *Attorney, Agent, or Firm* — Oblon, Spivak, McClelland, Maier & Neustadt, L.L.P.

(57) ABSTRACT

A train control system that does not allow running by erroneously receiving a signal of a further preceding train toward the front, nor permits a following train approaching another train beyond an allowable range. The system includes an existing signal system controlling running of a preceding train and a following train based on transmission signals from existing signal transmission devices, an inter-train communications system controlling running of the following train by an inter-train communications transmission signal received from the preceding train, and a train-ID transmission/reception system that detects, using a ground-based train-ID transmission/reception device, passing of the preceding train and also acquires train information of the preceding train, and that then detects passing of the following train and also transmits the train information to the following train, thereby controlling the running of the following train utilizing either one of the existing signal system and the inter-train communications system by changing over therebetween based on the train information.

8 Claims, 17 Drawing Sheets

U.S. PATENT DOCUMENTS

| | | | | |
|---|---|---|---|---|
| 7,200,470 | B2 * | 4/2007 | Oguma et al. | 701/19 |
| 7,201,350 | B2 * | 4/2007 | Sugita et al. | 246/122 R |
| 7,269,487 | B2 * | 9/2007 | Watanabe et al. | 701/19 |
| 7,317,987 | B2 * | 1/2008 | Nahla | 701/301 |
| 8,140,250 | B2 * | 3/2012 | Mian et al. | 701/117 |
| 8,145,368 | B2 * | 3/2012 | Won et al. | 701/20 |
| 8,264,330 | B2 * | 9/2012 | Yeldell et al. | 340/10.1 |
| 8,335,627 | B2 * | 12/2012 | Cho et al. | 701/97 |
| 2011/0184596 | A1 * | 7/2011 | Andreasson | 701/19 |
| 2012/0245770 | A1 * | 9/2012 | Yamamoto et al. | 701/20 |
| 2012/0265379 | A1 * | 10/2012 | Chen et al. | 701/20 |

FOREIGN PATENT DOCUMENTS

| | | |
|---|---|---|
| JP | 10 71952 | 3/1998 |
| JP | 11 245820 | 9/1999 |
| JP | 2001 100840 | 4/2001 |
| JP | 2002 27617 | 1/2002 |
| JP | 2004 359089 | 12/2004 |

OTHER PUBLICATIONS

Chinese Office Action issued May 30, 2012, in China Patent Application No. 200980126499.8 (with English translation).

* cited by examiner

FIG.7

| 7001 Train ID | 7002 Route number |
|---|---|
| XXX | YYY |
| PPP | QQQ |
| ..... | ..... |

TRAIN CONTROL SYSTEM

TECHNICAL FIELD

The present invention relates to a train control system that controls trains by transmitting and receiving information between the trains.

BACKGROUND ART

In a train control system utilizing conventional inter-train communications, a preceding train transmits to a following train a transmission signal including a train ID (identification data: a number or the like for distinguishing a train) and a train location, an onboard device of the following train reads out the received train ID and train location of the preceding train, and the running speed of the following train is controlled based on a current location and a train speed of the following train that are sensed or calculated similarly to the preceding train (for example, refer to Patent Document 1).

Meanwhile, as an existing signal system that controls trains without using the inter-train communications, there is an Automatic Train Control (ATC) signal system in which a rail track is divided into track sections, and trains are detected in each of the track sections, whereby, based on the detected information, a transmission signal including information for controlling that only one train can enter into each of the track sections is transmitted by the rail track as a transmission medium on an every track section basis (for example, refer to Non-Patent Document 1).

In addition, as another existing signal system that controls trains without using the inter-train communications, there is an automatic train control system by radio in which, without dividing a rail track into track sections, individual trains measure locations of the trains themselves and transmit them to a ground-based device, whereby the ground-based device determines a stop location of a following train based on a train location of a preceding train, and the ground-based device transmits using a radio device a transmission signal by this existing signal system to the following train (for example, refer to Patent Document 2).

In the train control system utilizing the inter-train communications described above, trains can be made running closer to each other in comparison with the existing signal systems that control the trains without using the inter-train communications. Namely, in comparison with the train control by the ATC signal system in which only one train can enter into each of the track sections, the following train runs based on the train location of the preceding train, so that a closer running can be achieved.

In addition, in comparison with the train control using an automatic train control system by radio in which the location information of a preceding train is transmitted to a following train once by means of the ground-based device, a delay time for receiving information of the train location by the following train can be shortened, so that a closer running can be achieved.

RELATED ART DOCUMENTS

Patent Document

[Patent Document 1] Japanese Laid-Open Patent Publication No. 2002-27617 (Paragraphs 0035 through 0047, FIG. 1)

[Non-Patent Document 1] *IPSJ Magazine,* Vol. 48, No. 8, August 2007 (P. 864 through 869)

[Patent Document 2] Japanese Laid-Open Patent Publication No. H02-109770 (Line 2 of upper-right column in page 3 through line 5 of upper-left column in page 5, FIG. 4)

DISCLOSURE OF THE INVENTION

Problems to be Solved by the Invention

However, in the train control system utilizing the conventional inter-train communications described above, there arises a problem in that, when a following train erroneously receives not a signal of an immediately preceding train, but that of a further preceding train toward the front, the following train may approach the normally preceding train beyond an allowable range if the running speed of the following train is controlled based on the train location of said further preceding train.

In addition, in a case in which a preceding train and a following train are to arrive at a station in different platforms, when the following train receives from the preceding train a signal and, based on it, controls the running speed, there may arise a problem in that the following train enters a rail track's divergence point even though it is not turned to the designated direction, and a problem in that the following train approaches a train in arriving in a platform which differs from that of the preceding train, beyond an allowable range.

Note that, in this description, "front" stands for a direction toward ahead of a proceeding train, and "rear" stands for the opposite direction to the train-proceeding direction.

The present invention has been directed at solving those problems described above, and an object of the invention is to provide a train control system that prevents running by erroneously receiving a signal of the further preceding train toward the front, that can control the following train when inter-train intervals become wider or when a radio signal transmission device of the preceding train malfunctions, and that prevents, when platforms in which the preceding train and the following train arrive are different with each other, the following train from approaching another train beyond an allowable range and from entering the divergence point even though it is not turned to the designated direction.

Means for Solving the Problems

A train control system according to the present invention comprises a first control system for controlling, based on a control signal from the ground side, running of a first train and a second train that runs following the first train; a second control system for controlling the running of the second train by an inter-train signal received from the first train including first identification information for distinguishing the first train; and a third control system that detects passing of the first train from the ground side and also acquires train information including second identification information that distinguishes the first train, and that then detects passing of the second train from the ground side and also transmits the train information to the second train, thereby controlling running of the second train utilizing either one of the first control system and the second control system by changing over therebetween based on the train information, provided that the third control system changes over to the first control system when the second identification information in the train information received by the second train differs from the first identification information of the inter-train signal.

In addition, another train control system according to the present invention comprises a first control system for controlling, based on a control signal from the ground side, running of a first train and a second train that runs following the first train; a second control system for controlling the running of the second train by an inter-train signal received from the first train; and a third control system that detects passing of the first train from the ground side and also acquires train information of the first train, and that then detects passing of the second train from the ground side and also transmits the train information to the second train, thereby controlling running of the second train utilizing either one of the first control system and the second control system by changing over therebetween based on the train information, provided that the third control system sets, as the train information, confirmation failure information when the train information cannot be acquired from the first train, and then changes over to the first control system when the second train acquires the train information including the confirmation failure information.

Effects of the Invention

According to the present invention, the train control system controls, based on train information acquired from the preceding train, the running of a following train by changing over between a train control system utilizing inter-train communications and an existing signal system that controls trains without using the inter-train communications, so that it is possible to prevent the running by erroneously receiving a signal of the further preceding train toward the front, and the following train can be controlled also when inter-train intervals become wider or when a radio signal transmission device of the preceding train malfunctions.

In addition, even when platforms of a station for the preceding train and the following train to arrive are different with each other, it is possible to prevent the following train from approaching another train beyond an allowable range, and from entering the divergence point when it is not turned to the designated direction.

BRIEF DESCRIPTION OF DRAWINGS

FIG. 7 is a diagram showing an example of a cancellation prevention route table in the route control device of the train control system in Embodiment 1 according to the present invention;

EXPLANATION OF NUMERALS AND SYMBOLS

"1005" designates a transmission signal;
"1103," preceding train;
"1104," following train;
"1020," onboard train-ID transmission/reception device's transmission signal;
"1025," inter-train communications reception device;
"1030," "1031," inter-train communications transmission signal;
"1035," inter-train communications transmission device;
"1040," ground-based train-ID transmission/reception device's transmission signal;
"1045," onboard train-ID transmission/reception device;
"1050," ground-based train-ID transmission/reception device;
"1060," route control device;
"1200," existing signal system;
"1201," inter-train communications system;
"1202," train-ID transmission/reception system;
"2001," inter-station leaving location;
"2002," first station-entering location;
"2003," train braking distance;
"2004," second station-entering location;
"2052," rail track's divergence point;
"2061," departure station;
"2062," next station;
"2101," train;
"2102," train;
"3000," ground-based inter-train communications running-continuation-distance memory-unit;
"3001," ground-based train ID memory-unit;
"3002," ground-based train ID transmission/reception control unit;
"3003," ground-based train ID reception unit;

"3004," ground-based train ID transmission unit;
"3005," train detection device;
"5005," inter-station leaving location;
"5006," second station-entering location;
"5007," first station-entering location;
"5061," "5062," inter-train communications running continuation distance;
"5071," "5072," route control device;
"5081," "5082," "5083," ground-based train-ID transmission/reception device;
"6101," route control unit;
"6102," continuous operation determination unit;
"6103," train diagram;
"6104," cancellation prevention route table;
"7001," train ID;
"7002," route number;
"9004," onboard inter-train communications control device;
"9005," inter-train communications control information memory-unit;
"11001," inter-train communications transmission-signal relay device;
"11002," inter-train communications transmission-signal relay device's control unit;
"11003," passing train ID memory-unit;
"15003," crossing control device;
"15004," grade crossing; and
"15005," block section.

BEST MODE FOR CARRYING OUT THE INVENTION

Figure 15:
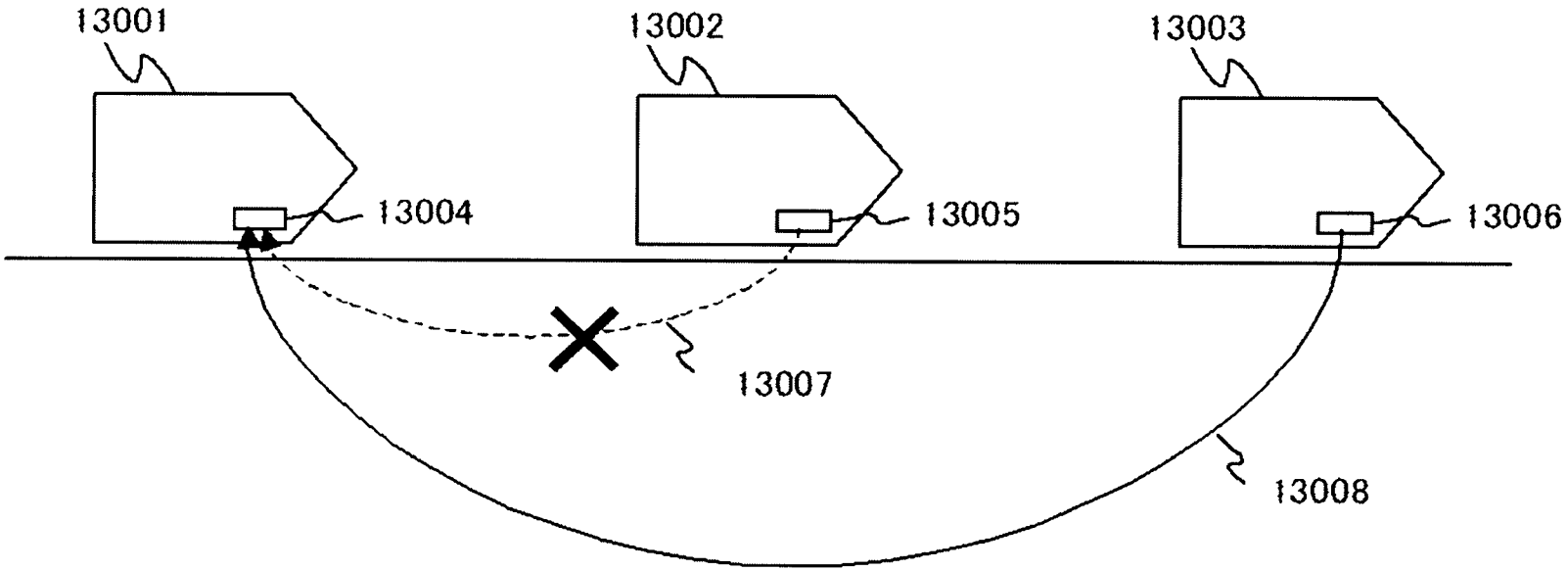
FIG. 15 is a schematic diagram for explaining a problem in a conventional train control system.
Figure 16:
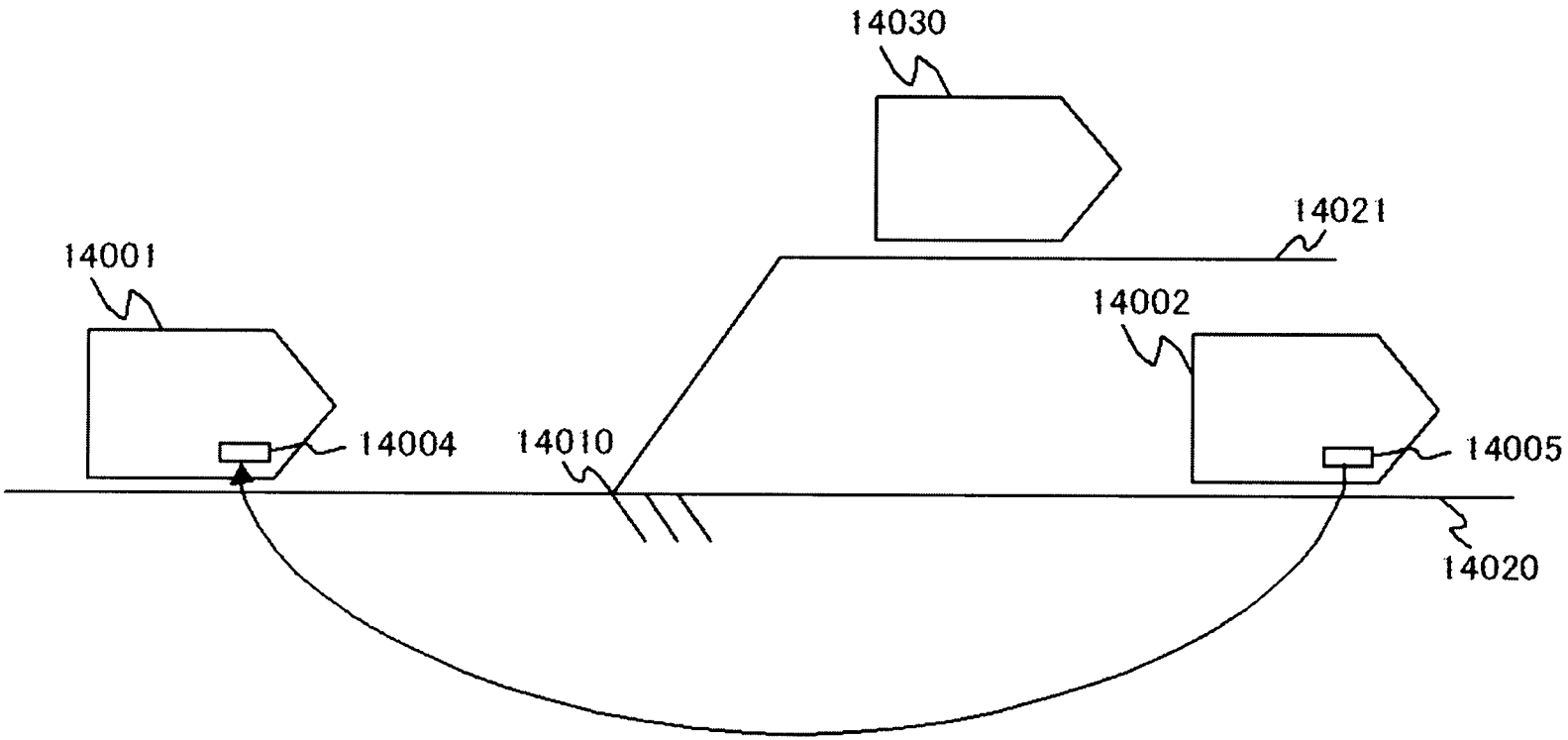
FIG. 16 is a schematic diagram for explaining a problem in the conventional train control system.

FIG. 15 and FIG. 16 are diagrams for explaining specific examples of the problems that the present invention has been directed at solving. In FIG. 15, numeral "13001" designates a following train, numeral "13002" designates a normally preceding train, and numeral "13003" designates a further preceding train toward the front. In usual cases, the following train 13001 receives by a reception device 13004 a transmission signal 13007 including a train ID and a train location that the normally preceding train 13002 transmits by a transmission device 13005, and performs the control based on this.

However, for example, due to a reason on account of which a malfunction occurs in the transmission device 13005 of the preceding train 13002, the preceding train 13002 is a train that does not have the transmission device 13005 in the first place, or so forth, there is also a case in which the following train 13001 cannot receive the transmission signal 13007, but receives a transmission signal 13008 of the further preceding train 13003 toward the front.

For dealing therewith, in Patent Document 1, a following train stores for identifying individual trains in track sections, a table of train ID codes (refer to Paragraph [0026] in Patent Document 1), which is used for confirming that the preceding train is the train that is running directly in front of the following train (refer to Paragraph [0044] in Patent Document 1).

However, according to the configurations described above, presuming that the train 13003 is set as the preceding train according to the diagram at the time when a train ID code of the preceding train is stored in the following train 13001, and therefore the train "13002" is inserted as a preceding train of the following train due to a diagram modification or the like, there arises a risk in that the following train 13001 runs erroneously recognizing the train 13003 as the preceding train, and approaches the preceding train 13002 after the diagram modification beyond an allowable range.

In FIG. 16, a preceding train 14002 is to arrive in a platform 14020, so that a route control device controlling the routes to a station controls a divergence point 14010 toward the platform 14020 until the preceding train 14002 passes through the point. When a next, following train 14001 is to arrive in a platform 14021 that is different from that of the preceding train 14002, the route control device switches the divergence point 14010 toward the platform 14021 after having the preceding train 14002 passed therethrough.

However, when the following train 14001 controls its speed based on a location of the preceding train 14002 determined by a signal from the preceding train 14002, there arises a risk in that the following train 14001 passes through the divergence point 14010 before the divergence point 14010 completes its switching, entering the divergence point even though it is not turned to the designated direction.

Moreover, even when the following train could pass through the divergence point 14010, another train 14030 is existing on the track in the platform 14021, and therefore, when a train location of the train 14030 is near the location of the following train 14001 than that of the preceding train 14002, there arises a risk in that the following train 14001 that controls its speed based on the train location of the preceding train 14020 cannot accomplish appropriate braking, resulting in approaching the train 14030 beyond an allowable range.

The present invention has been directed at solving those problems described above, and, hereinafter, train control systems according to the present invention will be explained referring to the drawings in various embodiments.

EMBODIMENT 1

Figure 1:
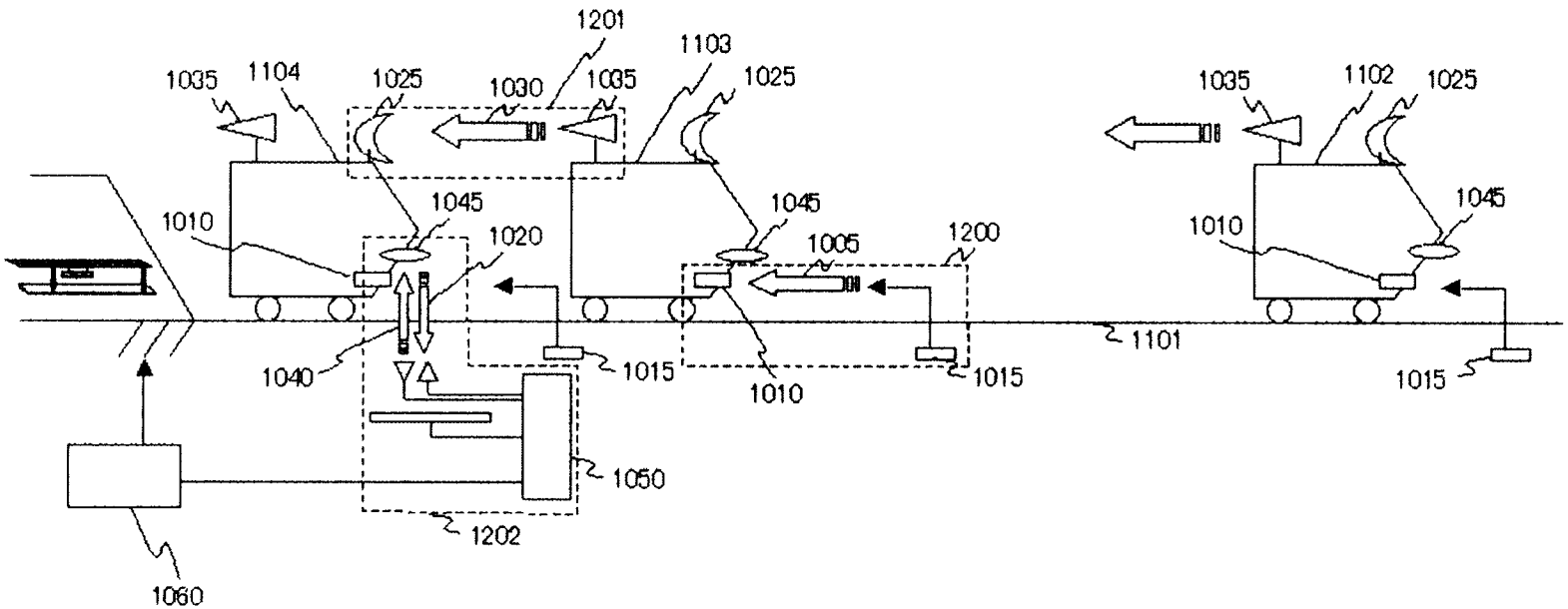
FIG. 1 is a schematic diagram illustrating a configuration of a train control system in Embodiment 1 according to the present invention.

FIG. 1 is a schematic diagram illustrating a configuration of a train control system in Embodiment 1 according to the present invention.

In FIG. 1, on a rail track 1101, a following train 1104 as a second train, a preceding train 1103 as a first train, and a further front train 1102 are running. The train control system in Embodiment 1 is constituted of an existing signal system 1200 serving as a first control system that controls trains without using inter-train communications, an inter-train communications system 1201 serving as a second control system, and a train-ID transmission/reception system 1202 serving as a third control system.

First, the explanation will be made for the existing signal system 1200 that controls trains without using inter-train communications, which is a constituent element of the train control system in Embodiment 1.

The existing signal system 1200 in Embodiment 1 that controls trains without using inter-train communications includes at least existing signal transmission devices 1015 placed on the ground, an existing signal reception device 1010 mounted on a train, and transmission signals 1005 transmitted from the existing signal transmission devices 1015 to the existing signal reception device 1010 of individual trains, whereby control signals for safely controlling the trains are transmitted to the individual trains.

Note that, the existing signal system 1200 that is a constituent element of the train control system in Embodiment 1 is based on an ATC signal system; however, another existing signal system that controls trains without using the inter-train communications, for example, such as an existing signal system in Patent Document 2 is also applicable.

Next, the inter-train communications system 1201 will be explained which is a constituent element of the train control system in Embodiment 1. The inter-train communications system 1201 includes at least an inter-train communications transmission device 1035 and an inter-train communications reception device 1025 mounted on each of the trains, and an inter-train communications transmission signal 1030 as an inter-train signal transmitted from the inter-train communications transmission device 1035 of the preceding train 1103 to the inter-train communications reception device 1025 of the following train 1104.

It is desirable that the inter-train communications transmission device 1035 be mounted to the trailing end of the train so that the inter-train communications transmission signal 1030 can be easily transmitted to the following train 1104. In addition, it is desirable that the inter-train communications reception device 1025 be mounted to the foremost portion of the train so that the inter-train communications transmission signal 1030 can be easily received from the preceding train 1103.

In addition, in the inter-train communications transmission signal 1030, included as information are a train ID for uniquely identifying the preceding train 1103, and the trailing-end location of the preceding train 1103 measured by the preceding train 1103. The following train 1104 performs the speed control so that the train can stop at least before the trailing-end location of the preceding train 1103 having been received from the preceding train 1103.

Next, the train-ID transmission/reception system 1202 will be explained which is a constituent element of the train control system in Embodiment 1.

The train-ID transmission/reception system 1202 includes at least a ground-based train-ID transmission/reception device 1050 serving as a ground-based transmission/reception device placed on the ground, an onboard train-ID transmission/reception device 1045 serving as an onboard transmission/reception device mounted on each of the trains, a ground-based train-ID transmission/reception device's transmission signal 1040 transmitted from the ground-based train-ID transmission/reception device 1050 to the onboard train-ID transmission/reception device 1045, and an onboard train-ID transmission/reception device's transmission signal 1020 transmitted from the onboard train-ID transmission/reception device 1045 to the ground-based train-ID transmission/reception device 1050.

In the onboard train-ID transmission/reception device's transmission signal 1020, included as information is a train ID as the train information for uniquely identifying a train that transmits the signal.

In the ground-based train-ID transmission/reception device's transmission signal 1040, included as the train information is a train ID of a preceding train 1103 that is running out just prior to the train currently transmitting the onboard train-ID transmission/reception device's transmission signal 1020 to the ground-based train-ID transmission/reception device 1050, or such information indicative of a confirmation failure of the preceding train 1103 when its running out just prior to the current train has been detected but its train ID is unsuccessful to identify.

Moreover, the ground-based train-ID transmission/reception device's transmission signal 1040 includes an inter-train communications running continuation distance as an allowable control-continuation distance that is control information indicative of a range that allows the train control by the inter-train communications transmission signal 1030 received from the preceding train 1103. The ground-based train-ID transmission/reception devices 1050 are placed, respectively, at least at an inter-station leaving location and at a second station-entering location that is located a train braking distance or more before a first station-entering location that is located prior to a divergence point to enter station platforms, and each of them can be connected to a route control device 1060 that controls routes to a station.

Figure 2:
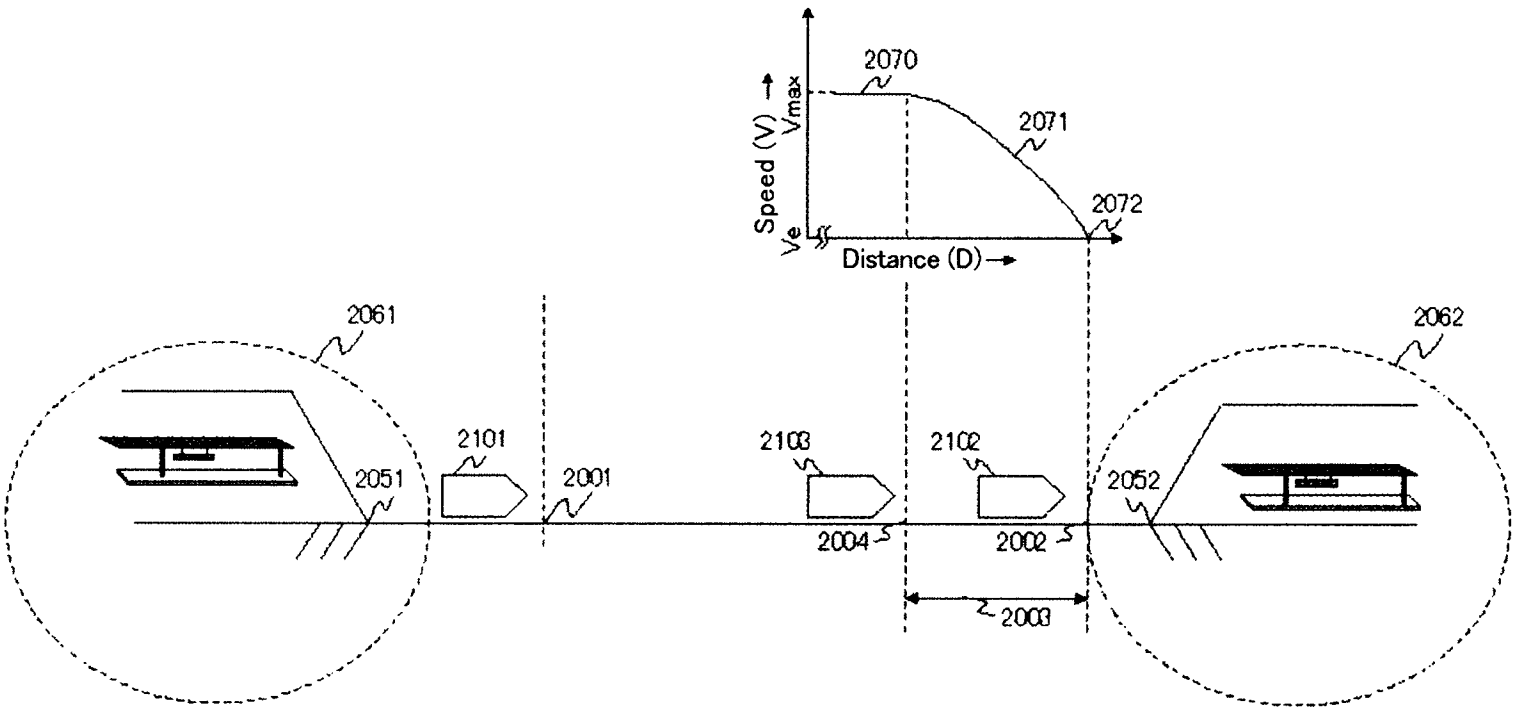
FIG. 2 is a schematic diagram for explaining an inter station leaving location and station-entering locations in a configuration of the train control system in Embodiment 1 according to the present invention.

Here, as shown in FIG. 2, the inter-station leaving location is a front location 2001 located in front of a train 2101 that departed the station and has reached just after the location where the trailing end of the train completely leaves out of a rail track's divergence point 2051 of the departure station 2061. The first station-entering location is a location 2002 located at the rear of a next station 2062, where the forefront of a train 2102 is just going to enter a rail track's divergence point 2052 of the next station.

The train braking distance designates the braking distance 2003, as shown by a graph of the relationship between a speed V and a distance D in FIG. 2, from a location 2004 at which a braking control starts in a state in which a train 2103 is in a maximum speed (train speed: V=Vmax) 2070, up to the location 2002 at which the train completely stops (V=0) 2072 after having decelerated the speed (V<Vmax) 2071.

In addition, the second station-entering location is the second station-entering location 2004 that is, as shown in FIG. 2, a location located the train braking distance 2003 before the first station-entering location 2002.

Figure 3:
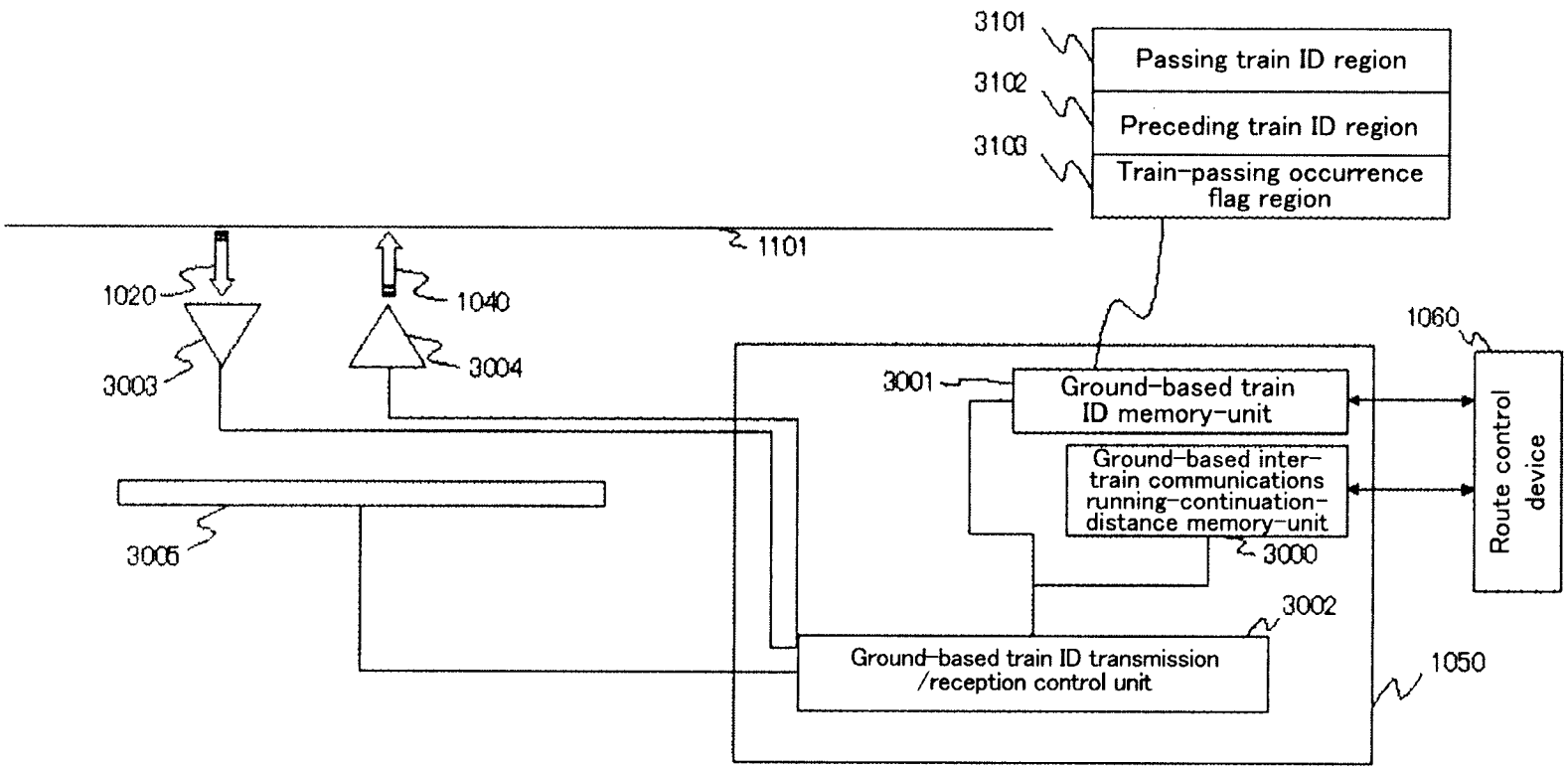
FIG. 3 is a block diagram illustrating a configuration of a ground-based train-ID transmission/reception device of the train control system in Embodiment 1 according to the present invention.

FIG. 3 is a schematic diagram illustrating a configuration of the ground-based train-ID transmission/reception device 1050 of the train control system in Embodiment 1 according to the present invention.

In FIG. 3, the ground-based train-ID transmission/reception device 1050 has a ground-based train ID reception unit 3003 as a ground-based reception unit for receiving the onboard train-ID transmission/reception device's transmission signal 1020 from a train, a ground-based train ID transmission unit 3004 as a ground-based transmission unit for transmitting the ground-based train-ID transmission/reception device's transmission signal 1040 to a train, a train detection device 3005 for detecting the train that passes through it, and a ground-based train ID transmission/reception control unit 3002 as a ground-based transmission/reception control unit for generating the ground-based train-ID transmission/reception device's transmission signal 1040 according to the input information from the ground-based train ID reception unit 3003 and the train detection device 3005.

Note that, as an example of the device that transmits/receives a transmission signal to/from a train, similarly to the ground-based train ID reception unit 3003 and the ground-based train ID transmission unit 3004, there is a transponder ground tag or beacon for rail. In addition, as an example of the train detection device 3005 that detects a passing train, there is the device referred to as a short track circuit that detects the passing train.

In addition, the ground-based train-ID transmission/reception device 1050 has a ground-based inter-train communications running-continuation-distance memory-unit 3000 as a second ground-based memory-unit and a ground-based train ID memory-unit 3001 as a first ground-based memory-unit, and the ground-based inter-train communications running-continuation-distance memory-unit 3000 and the ground-based train ID memory-unit 3001 are capable of reading in data by the route control device 1060.

Moreover, the ground-based train ID memory-unit 3001 has a train-passing occurrence flag region 3103 that records a train passing through above the train detection device 3005, a passing train ID region 3101 that records a train ID of a train just passing through above the train detection device 3005, and a preceding train ID region 3102 that records the train ID to be transmitted to the following train, and these pieces of information are set by the ground-based train ID transmission/reception control unit 3002.

In the ground-based inter-train communications running-continuation-distance memory-unit 3000, an inter-train communications running continuation distance is set by the route control device 1060. In the ground-based train-ID transmission/reception device 1050 placed at the inter-station leaving location 2001, a distance to the first station-entering location 2002 of the next station is set as the inter-train communications running continuation distance. Note that, the details of setting the inter-train communications running continuation distance will be described later referring to FIG. 5.

Figure 4:
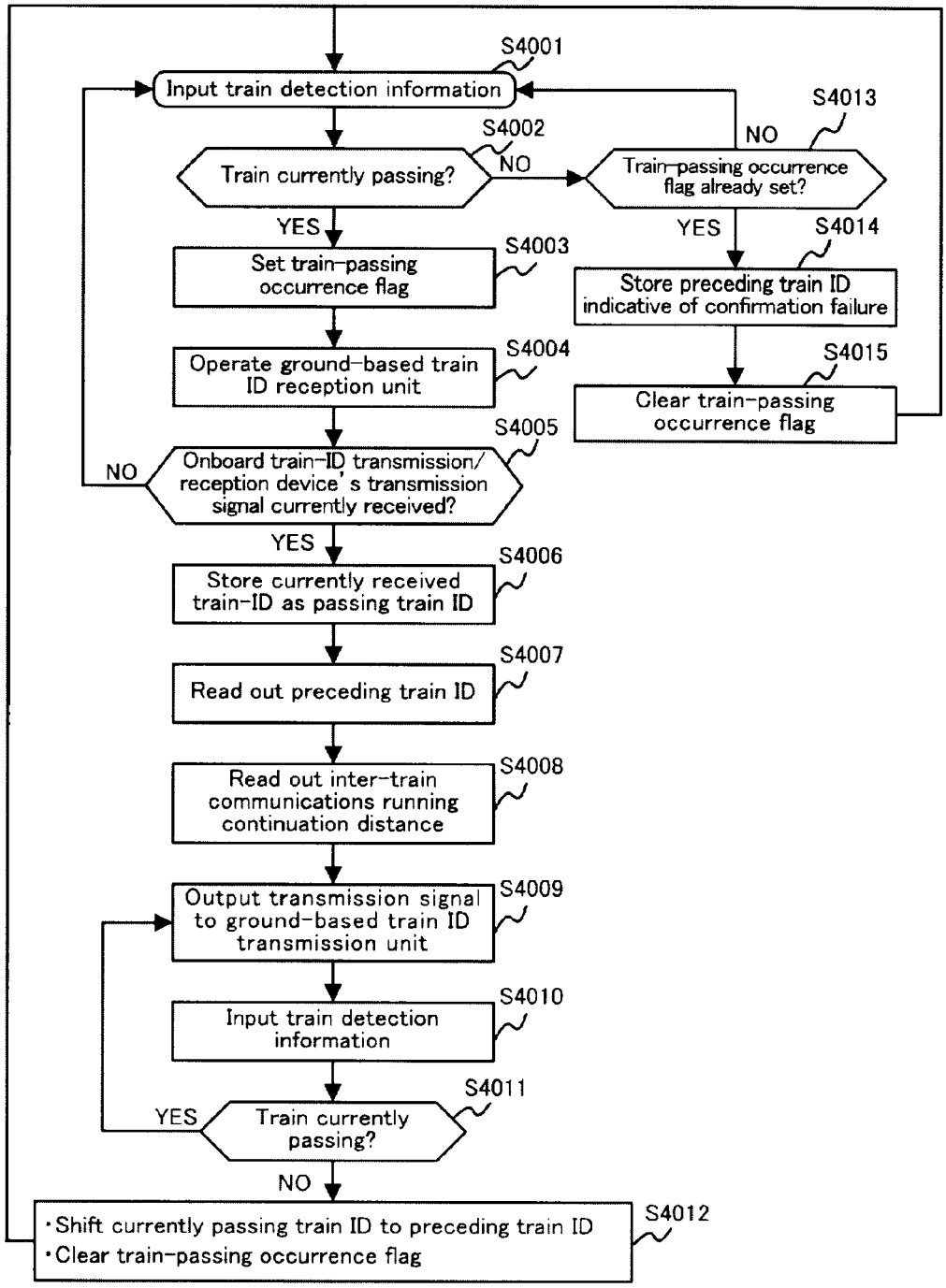
FIG. 4 is a flowchart illustrating operation procedures of processing in the ground-based train-ID transmission/reception device of the train control system in Embodiment 1 according to the present invention.

Next, according to the flowchart of FIG. 4, the operations of the ground-based train-ID transmission/reception device 1050 of the train control system in Embodiment 1 will be explained. FIG. 4 is the flowchart illustrating an example of the operations of the ground-based train-ID transmission/reception device 1050.

First, the ground-based train ID transmission/reception control unit 3002 of the ground-based train-ID transmission/reception device 1050 inputs train detection information from the train detection device 3005 (S4001), and checks whether a train is currently passing therethrough (S4002). If it is currently passing, a train-passing occurrence flag is set (S4003), and the ground-based train ID reception unit 3003 is put in operation (S4004).

Subsequently, the ground-based train ID transmission/reception control unit 3002 checks whether the onboard train-ID transmission/reception device's transmission signal 1020 is currently received (S4005), and if it is not received yet, returns to S4001 and continues checking to detect a train. When it is currently received, a train ID is read out from the onboard train-ID transmission/reception device's transmission signal 1020 currently received, and is stored into the ground-based train ID memory-unit 3001 as a passing train ID (S4006).

Next, the ground-based train ID transmission/reception control unit 3002 reads out a preceding train ID from the ground-based train ID memory-unit 3001 (S4007) and reads out an inter-train communications running continuation distance from the ground-based inter-train communications running-continuation-distance memory-unit 3000 (S4008), and generates from these the ground-based train-ID transmission/reception device's transmission signal 1040 to output it to the ground-based train ID transmission unit (S4009).

After outputting the ground-based train-ID transmission/reception device's transmission signal 1040, the ground-based train ID transmission/reception control unit 3002 again inputs the train detection information from the train detection device 3005 (S4010), and checks whether a train is currently passing therethrough (S4011). When it is currently passing, the output to the ground-based train ID transmission unit 3004 is continued (S4009).

When the train passing ends, the ground-based train ID transmission/reception control unit 3002 clears the train-passing occurrence flag set at S4003, and also registers the passing-completed train as a preceding train of the next passing train (S4012). Namely, a train ID stored in the ground-based train ID memory-unit 3001 as the currently passing train ID is shifted to a preceding train ID of the ground-based train ID memory-unit 3001. Subsequently, returning to S4001, checking of the train passing is continued.

Meanwhile, at S4002, if it is determined that a train is not passing, the ground-based train ID transmission/reception control unit 3002 checks whether a train-passing occurrence flag has already been set (S4013). When it is not set yet, since this means that a train has not passed through on the ground-based train-ID transmission/reception device, the processing returns again to S4001, and checking of the train passing is continued.

At S4013, when a train-passing occurrence flag has already been set, since this means that the onboard train-ID transmission/reception device's transmission signal 1020 cannot be received even though the train has completed its passing, the ground-based train ID transmission/reception control unit 3002 stores, instead of a preceding train ID, information indicative of a confirmation failure of a preceding train (S4014).

This is other predetermined information than the train ID uniquely identifying a train, and when a positive integer, for example, is used as the train ID, it may possibly be "0" or a negative number for the use. After having set the information indicative of a confirmation failure of a preceding train at S4014, the ground-based train ID transmission/reception control unit 3002 clears the train-passing occurrence flag (S4015), and returns for checking the train detection information input (S4001).

As noted above, the ground-based train-ID transmission/reception device 1050 in the train control system in Embodiment 1 stores at the inter-station leaving location 2001 or the like a train ID of the preceding train 1103, and transmits it to the following train 1104, and therefore, even when a modification or the like occurs in a train diagram, a train ID of the train that is actually running ahead can be transmitted to the following train.

Accordingly, even when the following train 1104 receives an inter-train signal of the further front train 1102, due to a malfunction or the like of the inter-train communications system 1201 of the preceding train 1103, it is possible to accurately distinguish whether or not the received signal is information from the actually preceding train, so that there is no such a case that the following train erroneously approaches the actually preceding train beyond an allowable range by performing the speed control based on that signal.

In addition, the ground-based train-ID transmission/reception device 1050 in the train control system in Embodiment 1 can transmits to the following train the information indicative of a confirmation failure of a preceding train, when the onboard train-ID transmission/reception device 1045 of the preceding train 1103 malfunctions, the preceding train 1103 does not have the onboard train-ID transmission/reception device 1045, or so forth.

Accordingly, the following train 1104 detects that some kind of problem occurred in the preceding train 1103, and then controls its running by the existing signal system 1200 that controls trains without using the inter-train communications, so that there is no such a case that the following train erroneously approaches the preceding train beyond an allowable range.

In addition, as to the ground-based train-ID transmission/reception device 1050 placed at the inter-station leaving location 2001, a train that has passed therethrough determines, as the inter-train communications running continuation distance, a distance from the leaving location up to the first station-entering location 2002 of the next station, the distance being included in the ground-based train-ID transmission/reception device's transmission signal 1040 received from the ground-based train-ID transmission/reception device 1050, so that, unless another ground-based train-ID transmission/reception device's transmission signal is received from the next ground-based train-ID transmission/reception device, the running control is performed by the existing signal system 1200 that controls trains without using the inter-train communications, from the first station-entering location 2002.

Therefore, when a transmission and/or reception failure of signal occurred due to a malfunction of the onboard train-ID transmission/reception device 1045 or the ground-based train-ID transmission/reception device 1050, the running control is performed by the existing signal system 1200, so that there is no such a case of entering a divergence point for station platforms even though it is not turned to the designated direction, nor approaching another train beyond an allowable range.

Figure 5:
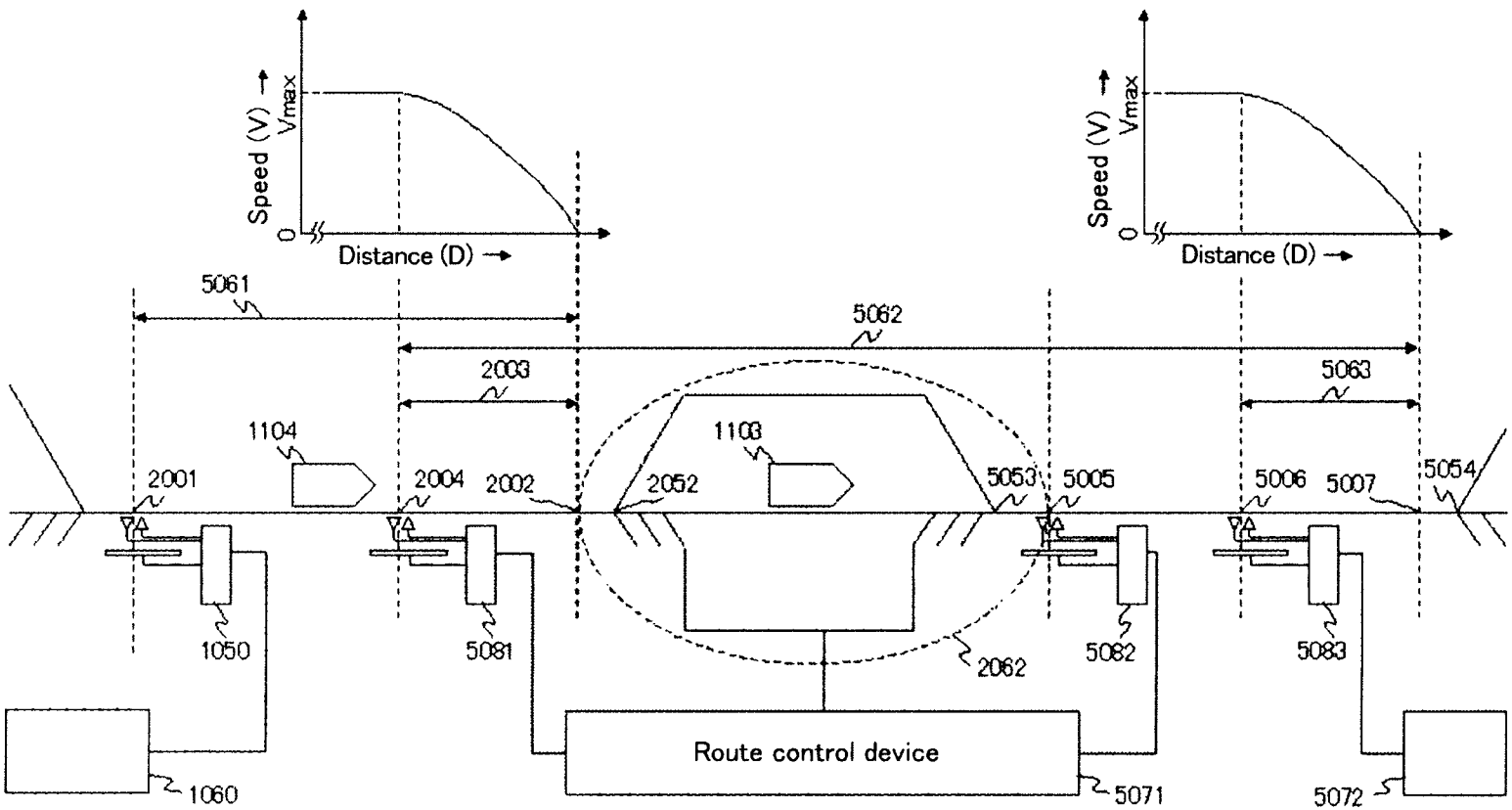
FIG. 5 is a schematic diagram illustrating an example of running trains controlled by ground-based train-ID transmission/reception devices of the train control system in Embodiment 1 according to the present invention.

FIG. 5 is a schematic diagram illustrating an example of the running trains controlled by the ground-based train-ID transmission/reception device 1050 placed at the inter-station leaving location 2001, and a ground-based train-ID transmission/reception device 5081 placed at the second station-entering location 2004, in the train control system in Embodiment 1 according to the present invention.

In FIG. 5, the following train 1104 is running while receiving a train ID and an inter-train communications running continuation distance 5061 of the preceding train 1103 from the ground-based train-ID transmission/reception device 1050 placed at the inter-station leaving location 2001. In front of the following train 1104, there is the ground-based train-ID transmission/reception device 5081 placed at the second station-entering location 2004.

The ground-based train-ID transmission/reception device 5081 placed at the second station-entering location 2004 is connected to a route control device 5071 of a station as approaching destination. In addition, a ground-based train-ID transmission/reception device 5082 placed at a next inter-station leaving location 5005 is connected to the route control device 5071 of the station as departure place.

The ground-based train-ID transmission/reception device 5081 transmits, when the following train 1104 is going to enter the next station and proceeds forward along the same route as the preceding train 1103, a distance to a next first station-entering location 5007 existing further toward the front, as an inter-train communications running continuation distance 5062 of the ground-based train-ID transmission/reception device 5081 placed at the second station-entering location 2004, to the following train 1104 by a continuous operation determination unit 6102.

Accordingly, the following train 1104 performs its train control by the inter-train communications transmission signal 1030 received from the preceding train 1103 by the inter-train communications reception device 1025, using the inter-train communications system 1201 up to the first station-entering location 5007 that exists toward the front by the inter-train communications running continuation distance 5062, so that, in a station yard, a closer train running can be achieved than that using the existing signal system 1200 that controls trains without using the inter-train communications.

In addition, the ground-based train-ID transmission/reception device 5081 transmits, when the following train 1104 is going to enter the next station and proceeds forward along a different route as the preceding train 1103, a distance from the second station-entering location 2004 to the first station-entering location 2002, as an inter-train communications running continuation distance 2003, to the following train 1104. Accordingly, the following train 1104 controls its running from the first station-entering location 2002 according to the existing signal system 1200 that controls trains without using the inter-train communications system 1201.

Moreover, when a malfunction occurs in the ground-based train-ID transmission/reception device 5081 and therefore, the following train 1104 does not receive the ground-based train-ID transmission/reception device's transmission signal 1040, the following train 1104 instead performs its running control according to the existing signal system 1200 that controls trains without using the inter-train communications, from the location existing toward the front by the inter-train communications running continuation distance 5061 that has already been received, namely from the first station-entering location 2002.

Thus, when the train is not allowed to enter the station because the divergence point 2052 is under switching operation or the like, it stops at the first station-entering location 2002, and therefore there is no such a case of entering the divergence point 2052 even though it is not turned to the designated direction, nor approaching another train beyond an allowable range.

Figure 6:
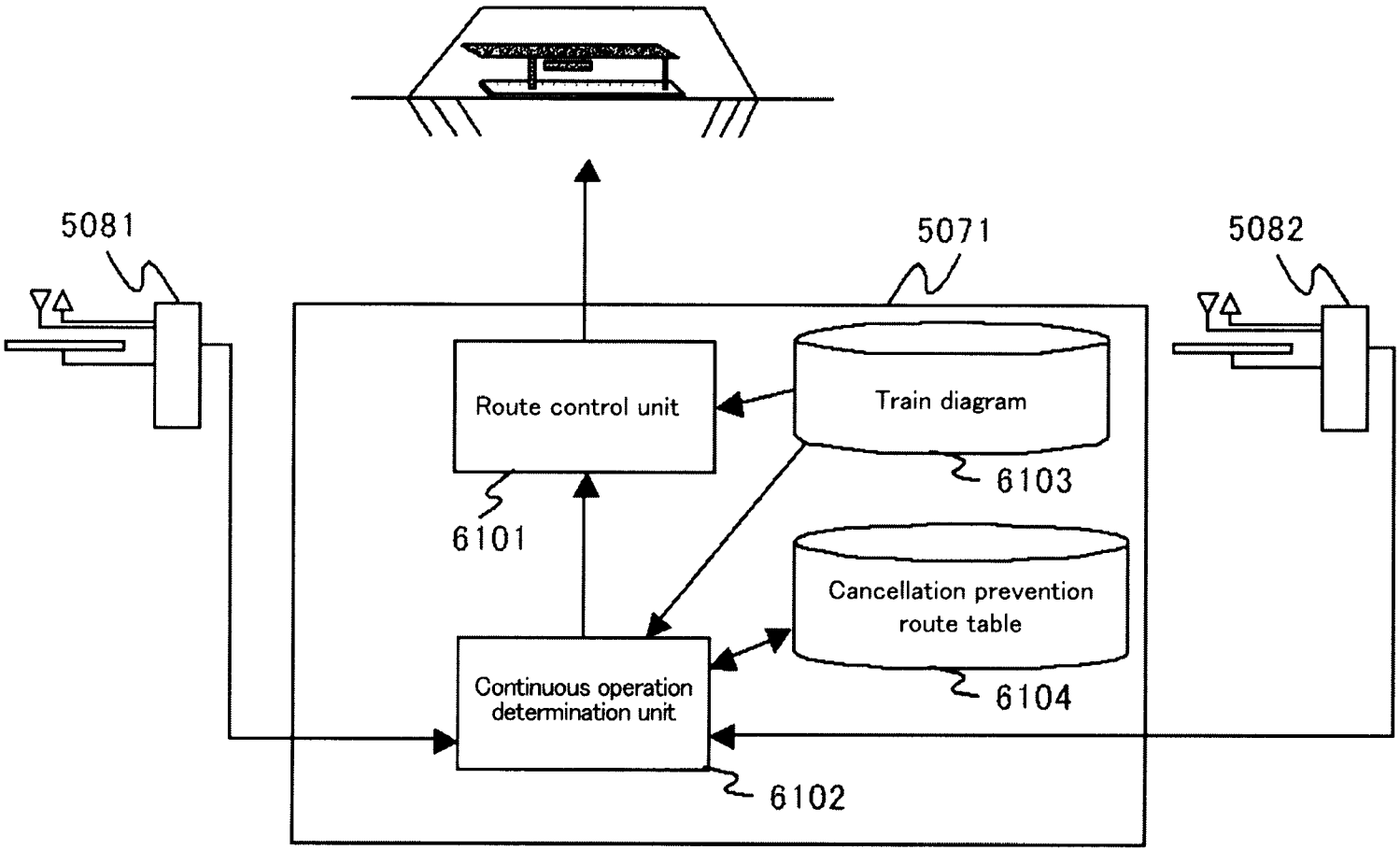
FIG. 6 is a block diagram illustrating a configuration of a route control device of the train control system in Embodiment 1 according to the present invention.

FIG. 6 is a schematic diagram illustrating a configuration of the route control device 5071 of the train control system in Embodiment 1 according to the present invention. In FIG. 6, the route control device 5071 has a train diagram 6103 developed as a first route memory-unit that records a route number and time information of every train to enter into a platform of the station 2062 as associated with each train ID, and a route control unit 6101 that controls routes to a station based on the train diagram 6103. The operations of the route control unit 6101 may suitably be the same as conventional ones, and thus their details are not described here.

In addition, the route control device 5071 has the continuous operation determination unit 6102 that determines whether or not the following train 1104 takes the same route as the preceding train 1103, and sets the inter-train communications running continuation distances 2003, 5061 or 5062 of the ground-based train-ID transmission/reception device 5081, and moreover when the same route is taken, prevents by the route control unit 6101 the same route from being cancelled until the following train 1104 passes through the route.

Moreover, the route control device 5071 has a cancellation prevention route table 6104 developed as a second route memory-unit that records routes to be prevented from cancellation for every one of the train IDs according to an instruction by the continuous operation determination unit 6102. An example of the cancellation prevention route table 6104 is shown in FIG. 7. The cancellation prevention route table 6104 has a region for recording in one record a train ID 7001 and a route number 7002 that uniquely identifies the route to be prevented from cancellation.

Figure 8:
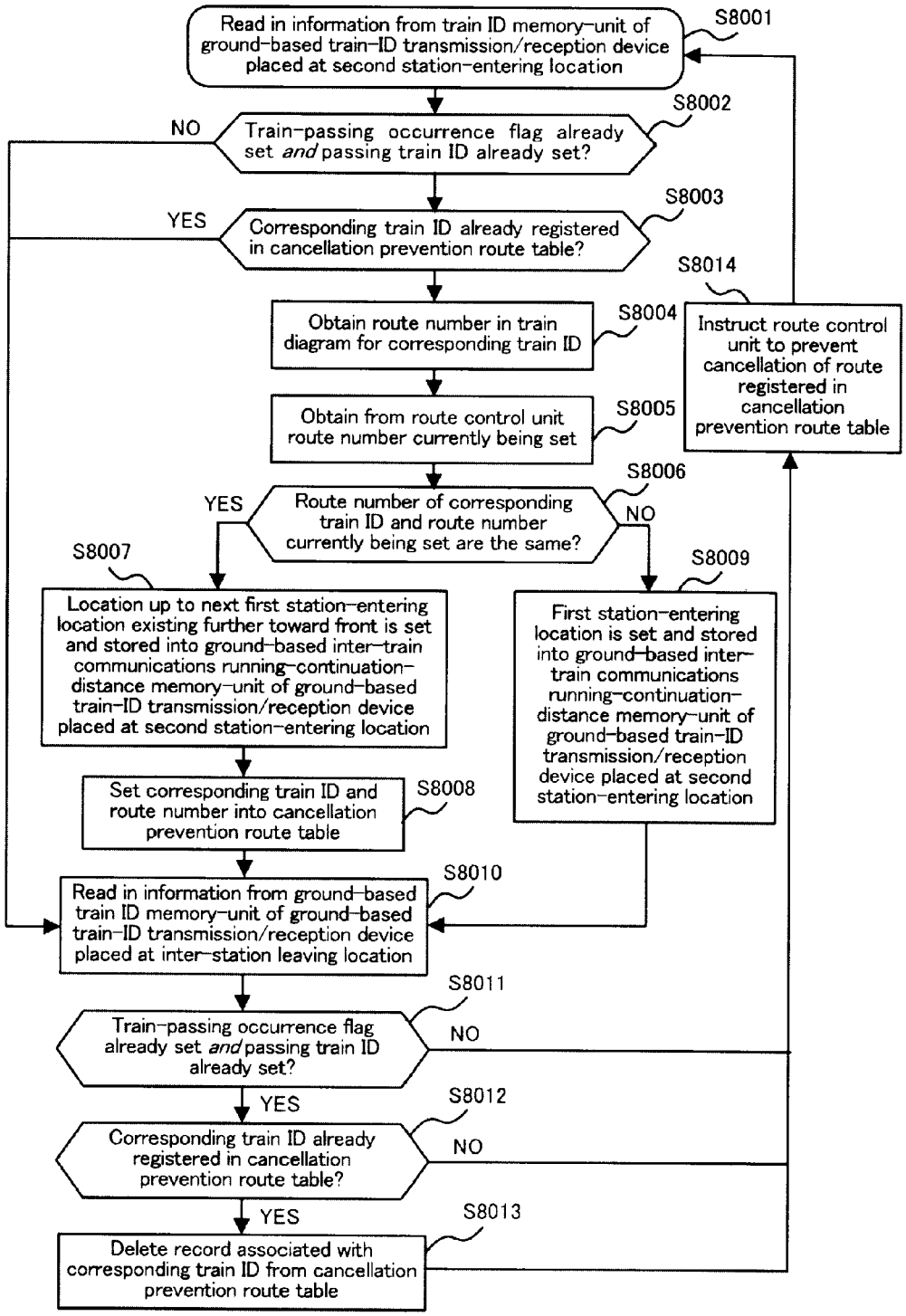
FIG. 8 is a flowchart illustrating operation procedures of processing in a continuous operation determination unit of the route control device of the train control system in Embodiment 1 according to the present invention.

Next, according to the flowchart of FIG. 8, the operations in the continuous operation determination unit 6102 of the route control device 5071 of the train control system in Embodiment 1 will be explained. FIG. 8 is the flowchart illustrating an example of the operations of the continuous operation determination unit 6102.

First, the continuous operation determination unit 6102 reads in, according to an instruction from the ground-based train-ID transmission/reception device 5081, information of the train ID memory-unit 3001 of the ground-based train-ID transmission/reception device 5081 placed at the second station-entering location 2004, when the following train 1104 reaches the second station-entering location 2004 toward the next station 2062 (S8001). Next, checking is made whether a train-passing occurrence flag has already been set and a passing train ID has already been set (S8002).

When both of these have already been set, the following train 1104 is currently passing through on the ground-based train-ID transmission/reception device 5081 placed at the second station-entering location 2004, and therefore the continuous operation determination unit 6102 checks by a train ID whether the following train 1104 has already been registered in the cancellation prevention route table 6104 (S8003).

When it has not registered yet, the continuous operation determination unit 6102 searches in the train diagram 6103 whereby the route control unit 6101 obtains a route number scheduled to be set for the following train 1104 (S8004). Next, a route number currently being set is obtained from the route control unit 6101 (S8005). Subsequently, the route number scheduled to be set for the following train 1104 and the route number currently being set are checked whether they are the same (S8006).

When they are the same, the following train 1104 is going to successively enter the route having been set for the preceding train 1103, and therefore the continuous operation determination unit 6102 sets for storing, as a location existing toward the front by the inter-train communications running continuation distance 5062 of the ground-based train-ID transmission/reception device 5081 placed at the second station-entering location 2004, a location up to the next first station-entering location 5007 existing further toward the front (S8007).

Subsequently, the continuous operation determination unit 6102 controls the train 5091 according to the inter-train communications system 1201 so that the train successively enters the route that has already been set. After the following train 1104 has passed through, the train ID 7001 and the route number 7002 of the following train 1104 are set into the cancellation prevention route table 6104 (S8008).

At S8006, if the route number scheduled to be set differs from the route number currently being set, the continuous operation determination unit 6102 sets the inter-train communications running continuation distance 2003 up to the first station-entering location 2002, in the ground-based train-ID transmission/reception device 5081 placed at the second station-entering location 2004 (S8009), so that the following train 1104 is controlled according to the existing signal system 1200 that controls trains without using the inter-train communications, from the first station-entering location 2002.

Note that, when, at S8002, a currently passing train is not the one whose train ID is recognizable, or when, at S8003, a train ID of the following train 1104 has already been registered in the cancellation prevention route table 6104, the operations of the cancellation prevention route table 6104 is no more required, so that the processes of S8004 through S8009 are not executed.

Next, the continuous operation determination unit 6102 reads in information of the ground-based train ID memory-unit 3001 of the ground-based train-ID transmission/reception device 5082 placed at the inter-station leaving location 5005, when the following train 1104 reaches the inter-station leaving location 5005 after departing the station 2062 (S8010). Next, checking is made whether the train-passing occurrence flag has already been set and the passing train ID has already been set (S8011).

When both of these have already been set, a train ID currently being set is checked whether it is already registered in the cancellation prevention route table 6104 (S8012). When it is already registered, since the following train 1104 that passed through on the ground-based train-ID transmission/reception device 5081 placed at the second station-entering location 2004 is confirmed to have left the station 2062, the record of the train ID 7001 of the following train 1104 is deleted from the cancellation prevention route table 6104 (S8013).

Note that, when, at S8011, a currently passing train through the ground-based train-ID transmission/reception device 5081 placed at the second station-entering location 2004 is not the one whose train ID is recognizable, or when, at S8012, a train ID of the following train 1104 is not set in the cancellation prevention route table 6104, the operations of the cancellation prevention route table 6104 is not required, so that the process of S8013 is not executed.

After ending the processes described above, the route control unit 6101 is instructed to prevent cancellation of the route registered in the cancellation prevention route table 6104 (S8014), and the route is locked so that it will not be erroneously cancelled.

As noted above, the continuous operation determination unit 6102 in the train control system in Embodiment 1 sets a location of the next first station-entering location 5007 existing further toward the front, as a destination location of the inter-train communications running continuation distance 5062 of the ground-based train-ID transmission/reception device 5081 placed at the second station-entering location 2004, when the following train 1104 that is currently passing through on the ground-based train-ID transmission/reception device 5081 placed at the second station-entering location 2004 takes the same route as the route already set and existing, thereby enabling a successive and closer running of the corresponding trains by the inter-train communications system 1201.

In addition, until the following train 1104 is confirmed to have passed through on the ground-based train-ID transmission/reception device 5082 placed at the inter-station leaving location 5005 existing further toward the front, the route of the following train 1104 is to be prevented from cancellation, and therefore there does not arise such a problem that, before a further following train enters into the route, the route control unit 6101 erroneously cancels the route, thereby allowing the further following train entering a route after the cancellation.

In addition, when the following train 1104 that is currently passing through on the ground-based train-ID transmission/reception device 5081 placed at the second station-entering location 2004 takes a different route from the route already set and existing, the following train 1104 is controlled from the first station-entering location 2002 by the existing signal system 1200 that controls trains without using the inter-train communications, by setting the first station-entering location 2002 as a destination location of the inter-train communications running continuation distance 2003 of the ground-based train-ID transmission/reception device 5081 placed at the second station-entering location 2004. Therefore, it is possible to prevent such a risk that the following train 1104 enters the rail track's divergence point 2052 even though the divergence point 2052 is not turned to the designated direction, and to avoid a case that the following train approaches a train in arriving in a platform which differs from that of the preceding train 1103, beyond an allowable range.

Moreover, in Embodiment 1, when an ATC signal system is used in particular for the existing signal system 1200 that controls trains without using the inter-train communications, the following effects can be obtained in comparison with an automatic train control device by radio in Patent Document 2.

Namely, in the automatic train control device by radio in Patent Document 2, in order to receive train signals of all the tracks, a ground-based overall radio transmission device is required to be installed so as to cover all the tracks, whereas in the train control system in Embodiment 1, it suffices that ground-based train-ID transmission/reception devices are placed at least at an inter-station leaving location and at a location that is located a train braking distance or more before the first station-entering location, so that it is not only possible to significantly simplify a ground-based radio facility, but also possible to achieve a close running of trains comparable or superior to that using the automatic train control device by radio in Patent Document 2.

Figure 9:
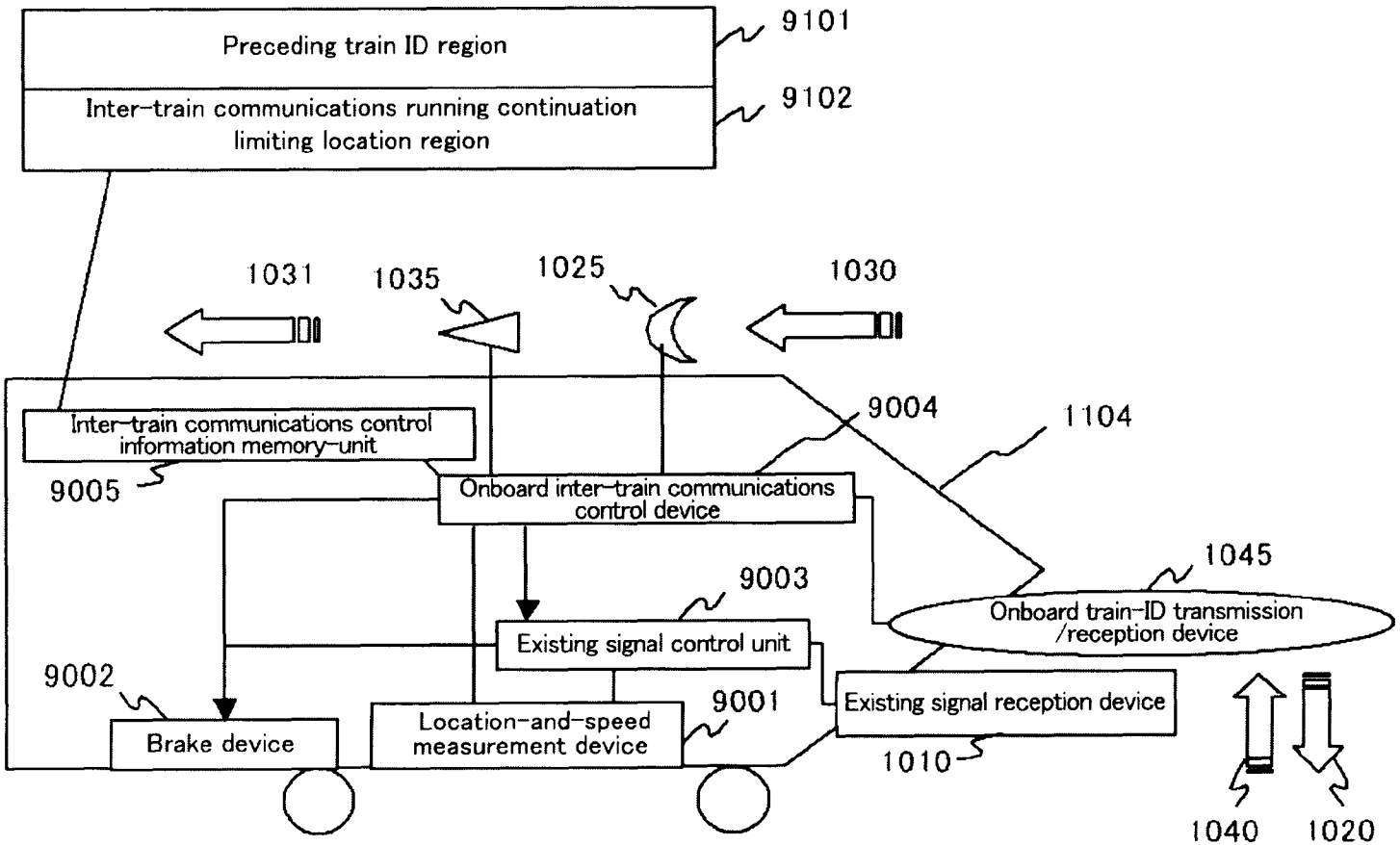
FIG. 9 is a block diagram illustrating a configuration of train-mounted devices of the train control system in Embodiment 1 according to the present invention.

FIG. 9 is a schematic diagram illustrating a configuration of train-mounted devices of the train control system in Embodiment 1 according to the present invention. In FIG. 9, an onboard inter-train communications control device 9004 as an onboard control device is connected to the inter-train communications reception device 1025 and the inter-train communications transmission device 1035, and the onboard train-ID transmission/reception device 1045 as an onboard transmission/reception device.

The onboard inter-train communications control device 9004 receives from the inter-train communications reception device 1025 the inter-train communications transmission signal 1030 including a train ID of the preceding train 1103 and the trailing-end location of the preceding train 1103 measured by the preceding train 1103 as the information, and transmits from the inter-train communications transmission device 1035 an inter-train communications transmission signal 1031 including a train ID of the following train 1104 and the trailing-end location of the following train 1104 measured by the following train 1104 as the information, to a further following train.

The onboard inter-train communications control device 9004 transmits, at all times, the onboard train-ID transmission/reception device's transmission signal 1020 including the information of an ID of the train itself by the onboard train-ID transmission/reception device 1045, and receives the ground-based train-ID transmission/reception device's transmission signal 1040 from the ground-based train-ID transmission/reception device 1050.

In addition, the onboard inter-train communications control device 9004 is connected to a location-and-speed measurement device 9001 and a brake device 9002, whereby a current location and a speed of the following train 1104 can be obtained by the location-and-speed measurement device 9001, and braking power is supplied by the brake device 9002 as the occasion requires.

Moreover, the onboard inter-train communications control device 9004 has an inter-train communications control information memory-unit 9005 serving as an onboard memory unit. Included in the memory unit are a preceding train ID region 9101 that stores a train ID of the preceding train 1103 in the ground-based train-ID transmission/reception device's transmission signal 1040 received, and an inter-train communications running continuation limiting location region 9102 that sets an inter-train communications running continuation limiting location obtained by adding a location of the current following train 1104 to information of the inter-train communications running continuation distance in the ground-based train-ID transmission/reception device's transmission signal 1040.

The following train 1104 has the location-and-speed measurement device 9001, and an existing signal control unit 9003 connected to the brake device 9002. The onboard inter-train communications control device 9004 is connected to the existing signal control unit 9003, and changes over the train control to that by the existing signal control unit 9003 as the occasion requires.

Figure 10:
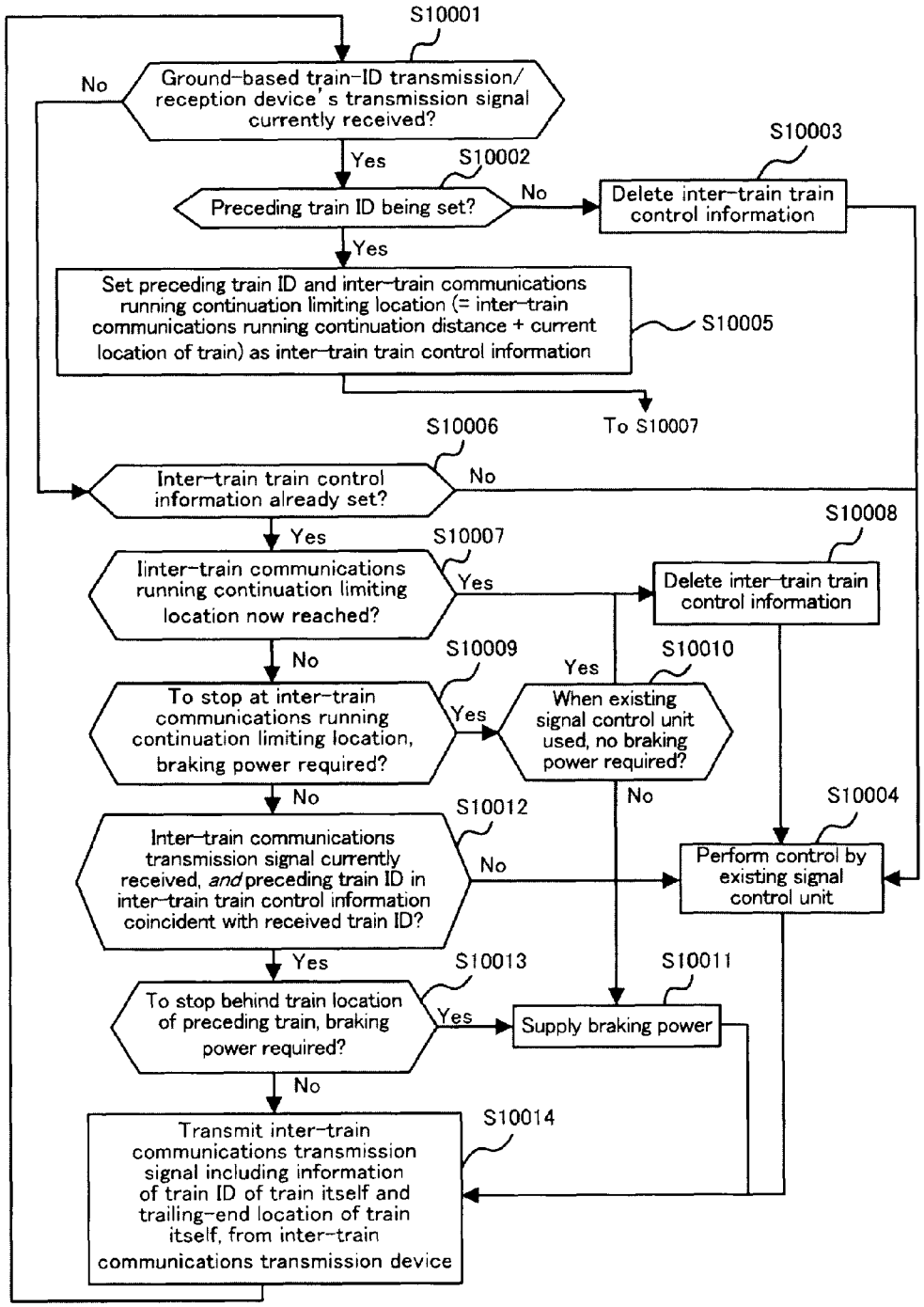
FIG. 10 is a flowchart illustrating operation procedures of processing in an onboard inter-train communications control device of the train control system in Embodiment 1 according to the present invention.

Next, according to the flowchart of FIG. 10, the operations in the onboard inter-train communications control device 9004 of the train control system in Embodiment 1 will be explained. FIG. 10 is the flowchart illustrating an example of the operations of the onboard inter-train communications control device 9004.

First, the onboard inter-train communications control device 9004 of the following train 1104 checks whether the ground-based train-ID transmission/reception device's transmission signal 1040 is received by the onboard train-ID transmission/reception device 1045 (S10001). When the signal is currently received, it is checked whether a preceding train ID is set in the ground-based train-ID transmission/reception device's transmission signal 1040 (S10002).

When the preceding train ID is not set, the onboard inter-train communications control device 9004 deletes from the inter-train communications control information memory-unit 9005, information in the preceding train ID region 9101 and the inter-train communications running continuation limiting location region 9102 (S10003), which serves as inter-train train control information.

In addition, when the preceding train ID is not set, since the preceding train 1103 is recognized to be under malfunction, or to have no onboard train-ID transmission/reception device 1045 mounted thereon which is a constituent element of the present invention, the train control cannot be performed using the inter-train communications, so that the onboard inter-train communications control device 9004 performs the train control of the following train 1104 without using the inter-train communications, by the existing signal control unit 9003 (S10004).

Therefore, when a train under malfunction or with no onboard train-ID transmission/reception device 1045 mounted thereon is the preceding train 1103, the following train 1104 is controlled by the existing signal system 1200 that controls trains without using the inter-train communications, so that there is no such a case that the preceding train 1103 and the following train 1104 approach beyond an allowable range with each other.

Note that, when information indicative of a confirmation failure of the preceding train 1103 is set instead of the preceding train ID in the ground-based train-ID transmission/reception device's transmission signal 1040, it is determined that the preceding train ID is not set.

At S10002, when the preceding train ID is set, the onboard inter-train communications control device 9004 sets in the inter-train communications control information memory-unit 9005, as inter-train train control information, a preceding train ID in the ground-based train-ID transmission/reception device's transmission signal 1040, and an inter-train communications running continuation limiting location that is a value obtained by adding a current location of the train itself to the inter-train communications running continuation distance (S10005).

At S10001, when the ground-based train-ID transmission/reception device's transmission signal 1040 is not currently received, the onboard inter-train communications control device 9004 checks whether inter-train communications control information is already set in the inter-train communications control information memory-unit 9005 (S10006). When it is not set, the control is performed by the existing signal control unit 9003 that controls trains without using the inter-train communications (S10004).

At S10006, when the inter-train communications control information is currently being set, the onboard inter-train communications control device 9004 checks by the onboard train-ID transmission/reception device 1045 whether a current location of the train itself reaches the inter-train communications running continuation limiting location (S10007).

When it is reached, the train control will not be performed by the inter-train communications system 1201 any longer, so that the onboard inter-train communications control device 9004 deletes the inter-train train control information from the inter-train communications control information memory-unit 9005 (S10008), and performs the control by the existing signal control unit 9003 that controls trains without using the inter-train communications (S10004).

At S10007, when the current location does not reach the inter-train communications running continuation limiting location yet, the onboard inter-train communications control device 9004 checks whether braking power is required to stop at the inter-train communications running continuation limiting location (S10009).

Here, a specific situation that requires the braking power to stop at the inter-train communications running continuation limiting location, corresponds to a case in which the onboard inter-train communications control device 9004 receives by the onboard train-ID transmission/reception device 1045, for example, a distance 2003 as shown in FIG. 5 from the ground-based train-ID transmission/reception device 5081 placed at the second station-entering location 2004 up to the first station-entering location 2002.

When a braking output is required, it is then checked whether braking power is required when the existing signal control unit 9003 that controls trains without using the inter-train communications is used (S10010). When no braking output is required, the onboard inter-train communications control device 9004 deletes the inter-train train control information from the inter-train communications control information memory-unit 9005 (S10008), and performs the control by the existing signal control unit 9003 that controls trains without using the inter-train communications (S10004).

Here, a specific situation that requires no braking power when using the existing signal control unit 9003 that controls trains without using the inter-train communications, corresponds to a case in which, for example in FIG. 5, a route of the following train 1104 at the rail track's divergence point 2052 has already been set by the route control device 5071, and the existing signal system 1200 that controls trains without using the inter-train communications is in the state that permits the following train 1104 to proceed forward.

At S10010, if it is determined that braking power is required even when the existing signal control unit 9003 is used, the onboard inter-train communications control device 9004 supplies the braking power using the brake device 9002 (S10011).

At S10009, if it is determined that no braking power is required, the onboard inter-train communications control device 9004 checks whether the inter-train communications transmission signal 1030 is currently received from the inter-train communications reception device 1025, and whether the received train ID is coincident with the train ID of the preceding train 1103 in the inter-train communications control information (S10012).

If not in coincidence therewith, it can be understood that the signal of a train which differs from the preceding train 1103 has been received, and therefore, the onboard inter-train communications control device 9004 performs the control, without using this signal, by the existing signal control unit 9003 that controls trains without using the inter-train communications (S10004).

On the other hand, when the inter-train communications transmission signal 1030 is not received, it possibly be in a situation that the signal cannot be received because the preceding train 1103 is running far away, or the preceding train has no onboard train-ID transmission/reception device 1045 mounted thereon that is a constituent element of the present invention. In this situation, the onboard inter-train communications control device 9004 performs the control also by the existing signal control unit 9003 that controls trains without using the inter-train communications (S10004).

At S10012, if the train ID is in coincidence, which means that the signal of the preceding train 1103 is received, the onboard inter-train communications control device 9004 checks whether braking power is required for the train itself to stop behind the train location of the preceding train 1103, based on its train location and the train location of the preceding train 1103 in the inter-train communications transmission signal 1030 (S10013).

Note that, even though the signal cannot be received at S10012 because the preceding train 1103 is running far away, if the inter-train interval becomes narrower, the inter-train communications transmission signal 1030 may be receivable. This situation corresponds to the case in which the train ID of the preceding train 1103 is in coincidence at S10012, and therefore, the onboard inter-train communications control device 9004 can return to the train control using the inter-train communications transmission signal 1030 (S10013).

When the braking output is required, the onboard inter-train communications control device 9004 supplies the braking power using the brake device 9002 (S10011).

After ending the processes described above, the inter-train communications transmission signal 1031 including information of the train ID of the train itself and the trailing-end location of the train itself is transmitted from the inter-train communications transmission device 1035 (S10014), and the processing returns to S10001.

Therefore, when a signal of the preceding train 1103 cannot be received anymore by the onboard inter-train communications control device 9004, due to an unpredictable factor such as degradation of signal-related conditions, a safe train control can be realized immediately by the existing signal system 1200 thus changed over, which controls trains without using the inter-train communications, and moreover, when a signal of the preceding train 1103 becomes receivable again, it is possible to return immediately to the train control using the inter-train communications system 1201, allowing a train control with narrower inter-train intervals.

As described above, in Embodiment 1, the preceding train 1103 that actually enters a section between the stations transmits a train ID of the train itself to the ground-based train-ID transmission/reception device 1050 using the train-ID transmission/reception system 1202, and the following train 1104 receives from the ground-based train-ID transmission/reception device 1050 that train ID, which is used for identifying the preceding train 1103, so that, even when the following train erroneously receives a signal of a further preceding train toward the front, the signal can be accurately distinguished, and thus it is possible to prevent the following train from approaching the actually preceding train beyond an allowable range.

In addition, there is no need to modify a train ID code table or diagram information that is stored in the trains for identifying each of the trains whenever the diagram is modified, so that a maintenance becomes easy.

In addition, in a case in which the preceding train 1103 is not mounted with the onboard train-ID transmission/reception device 1045 that is a constituent element of the present invention, the ground-based train-ID transmission/reception device 1050 placed at the inter-station leaving location 2001 does not receive a train ID by the train detection device 3005 that detects trains without using the inter-train communications during the detection of the preceding train 1103, and the following train 1104 receives information indicative of a confirmation failure of the preceding train 1103 to thereby performs the train control according to the existing signal system 1200 that controls trains without using the inter-train communications, making it possible to prevent the following train from approaching the preceding train beyond an allowable range.

In addition, when an interval between the preceding train 1103 and the following train 1104 becomes wider so that the following train 1104 cannot receive the transmission signal anymore, the control is performed according to the existing signal system 1200 that controls trains without using the inter-train communications, so that the following train can be controlled even when a signal of a preceding train cannot be received.

Moreover, when the following train 1104 takes a route that differs to that of the preceding train 1103, the ground-based train-ID transmission/reception device 1050 transmits to the following train 1104 a distance up to the first station-entering location 2002 as the inter-train communications running continuation distance 2003, and the following train 1104 commences the control according to the existing signal system 1200 that controls trains without using the inter-train communications before the rail track's divergence point 2052, so that it is possible to prevent the train from entering a divergence point that is under switching operation and being left from the designated direction, and from approaching beyond an allowable range a train in stopping in a platform which is different from that of the preceding train that is running between the stations.

EMBODIMENT 2

Figure 11:
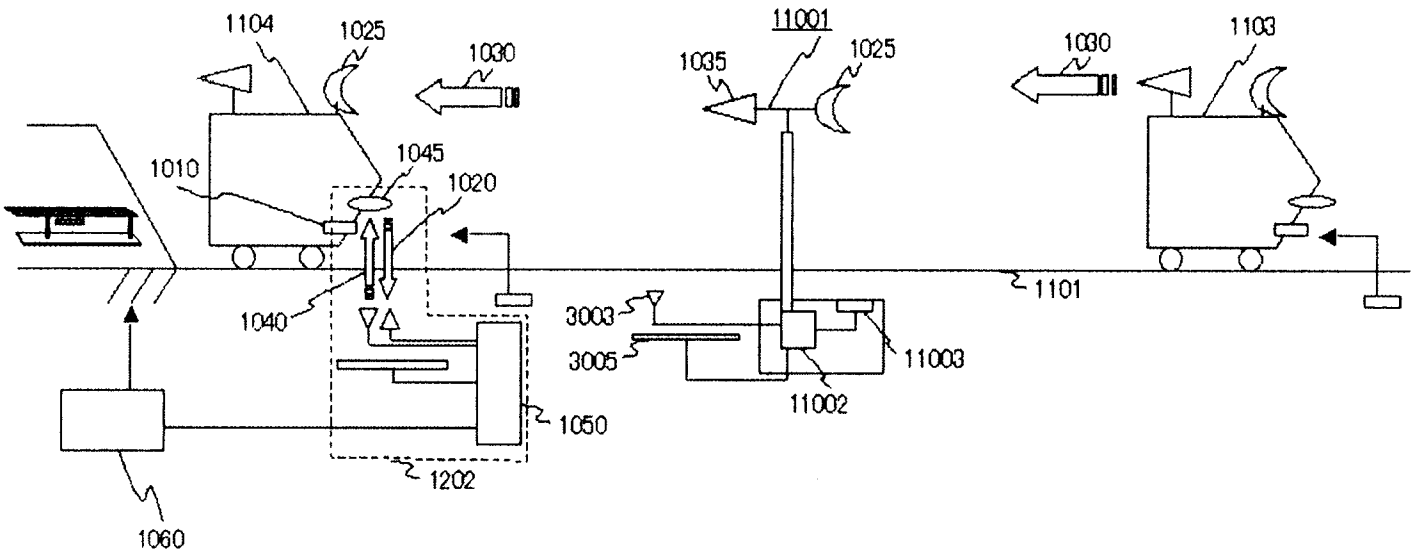
FIG. 11 is a schematic diagram illustrating a configuration of a train control system in Embodiment 2 according to the present invention.

FIG. 11 is a schematic diagram illustrating a configuration of a train control system in Embodiment 2 according to the present invention.

In FIG. 11, the configuration of the train control system in Embodiment 2 includes, in addition to the configuration in Embodiment 1, an inter-train communications transmission-signal relay device 11001 serving as an inter-train signal relay device. For other components, the same applies thereto as those in Embodiment 1, and the same reference numerals and symbols designate the same items as those shown in FIG. 1; thus, their explanation is omitted.

The inter-train communications transmission-signal relay device 11001 is provided for a purpose to deal with a case in which a train-to-train clearance between the preceding train 1103 and the following train 1104 is wide, or the inter-train communications transmission signal 1030 cannot be directly transmitted and received at a curved or like location of the rail track 1101.

The inter-train communications transmission-signal relay device 11001 is constituted of the inter-train communications reception device 1025 as a first relay reception device similar to that mounted on the preceding train 1103 or the following train 1104, the inter-train communications transmission device 1035 as a first relay transmission device, the ground-based train ID reception unit 3003 as a second relay reception device similar to that placed on the ground-based train-ID transmission/reception device 1050, and the train detection device 3005 as a relay train-detection device.

In addition, the inter-train communications transmission-signal relay device 11001 has an inter-train communications transmission-signal relay device's control unit 11002 serving as a relay transmission/reception control unit that controls the device, and a passing train ID memory-unit 11003 as a ground-based relay memory-unit that stores a train ID of the train which passed through on the device.

The inter-train communications transmission-signal relay device's control unit 11002 in the inter-train communications transmission-signal relay device 11001 stores in the passing train ID memory-unit 11003, a train ID received during the train detection by the train detection device 3005, and, when the inter-train communications transmission signal 1030 including the train ID is received by the inter-train communications reception device 1025, outputs the received signal from the inter-train communications transmission device 1035.

Figure 12:
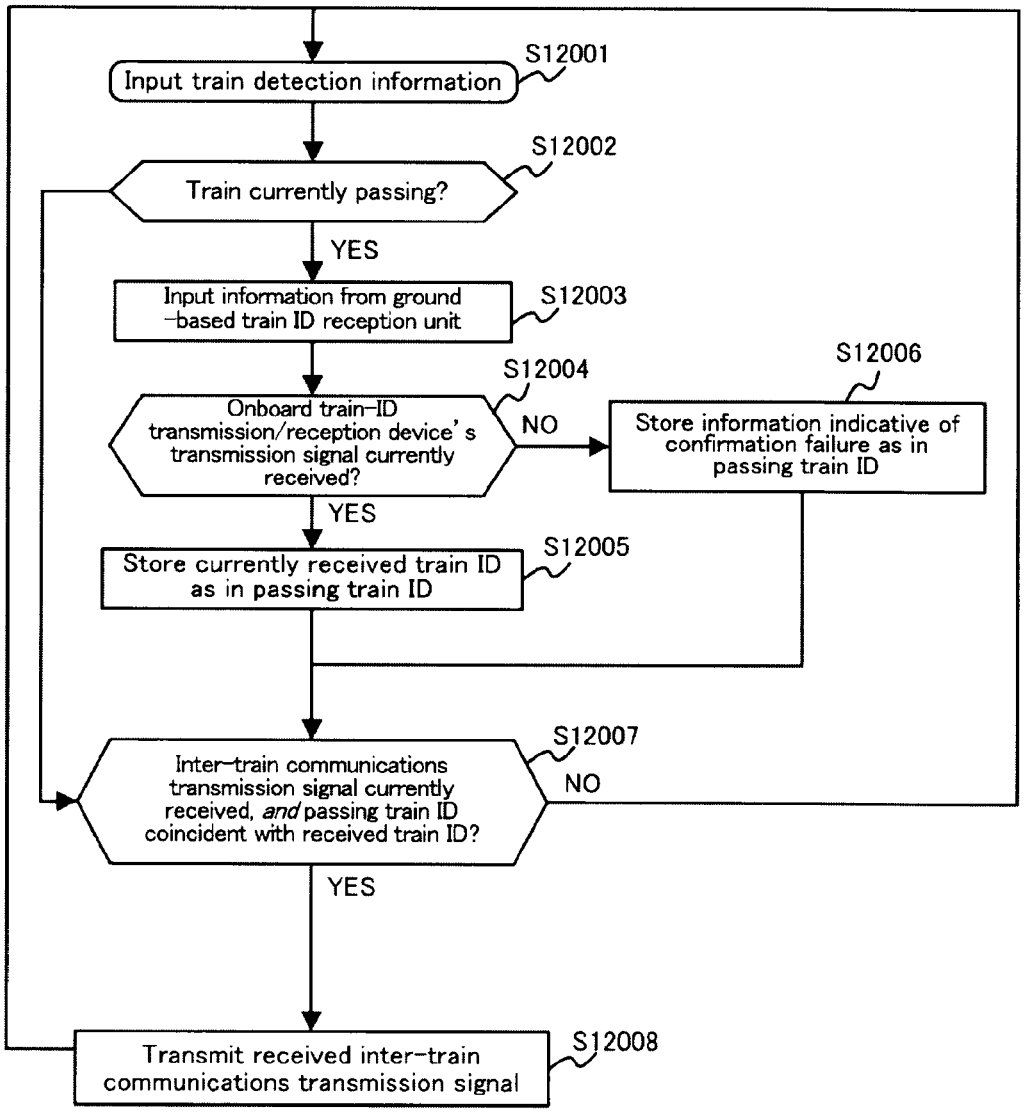
FIG. 12 is a flowchart illustrating operation procedures of processing in an inter-train communications transmission-signal relay device's control unit of the inter-train communications transmission-signal relay device of the train control system in Embodiment 2 according to the present invention.

Next, according to the flowchart of FIG. 12, the operations in the inter-train communications transmission-signal relay device's control unit 11002 of the inter-train communications transmission-signal relay device 11001 of the train control system in Embodiment 2 will be explained. FIG. 12 is the flowchart illustrating an example of the operations of the inter-train communications transmission-signal relay device's control unit 11002.

First, the inter-train communications transmission-signal relay device's control unit 11002 inputs train detection information from the train detection device 3005 (S12001), and checks whether a train is currently passing therethrough (S12002).

If a train is currently passing therethrough, the inter-train communications transmission-signal relay device's control unit 11002 inputs information from the ground-based train ID reception unit 3003 (S12003), and checks whether the reception unit currently receives the onboard train-ID transmission/reception device's transmission signal 1020 (S12004).

If it is currently received, the inter-train communications transmission-signal relay device's control unit 11002 stores the currently received train ID into the passing train ID memory-unit 11003 (S12005). If it is not currently received, information indicative of a confirmation failure of a passing train is stored in the passing train ID memory-unit 11003 (S12006).

Subsequently, the inter-train communications transmission-signal relay device's control unit 11002 checks whether the inter-train communications transmission signal 1030 is currently received by the inter-train communications reception device 1025, and whether the train ID in the signal is coincident with the train ID having been stored in the passing train ID memory-unit 11003 (S12007).

If in coincidence therewith, it can be understood that the signal of the train which has lastly passed through on the device is received, and therefore, the received inter-train communications transmission signal 1030 is transmitted to the following train 1104 by the inter-train communications transmission device 1035.

As described above, in Embodiment 2, even when an interval between the preceding train 1103 and the following train 1104 becomes wider so that the following train 1104 cannot receive the transmission signal anymore, a signal of the preceding train 1103 is transmitted to the following train 1104 by the train-ID transmission/reception system 1202 by means of the inter-train communications transmission-signal relay device 11001, so that a close running of trains can be achieved using the inter-train communications train control device 11001.

Note that, it may also be configured that a ground-based train ID transmission unit 3004 is added to the inter-train communications transmission-signal relay device 11001, to be used also with the ground-based train-ID transmission/reception device 1050.

EMBODIMENT 3

Figure 13:
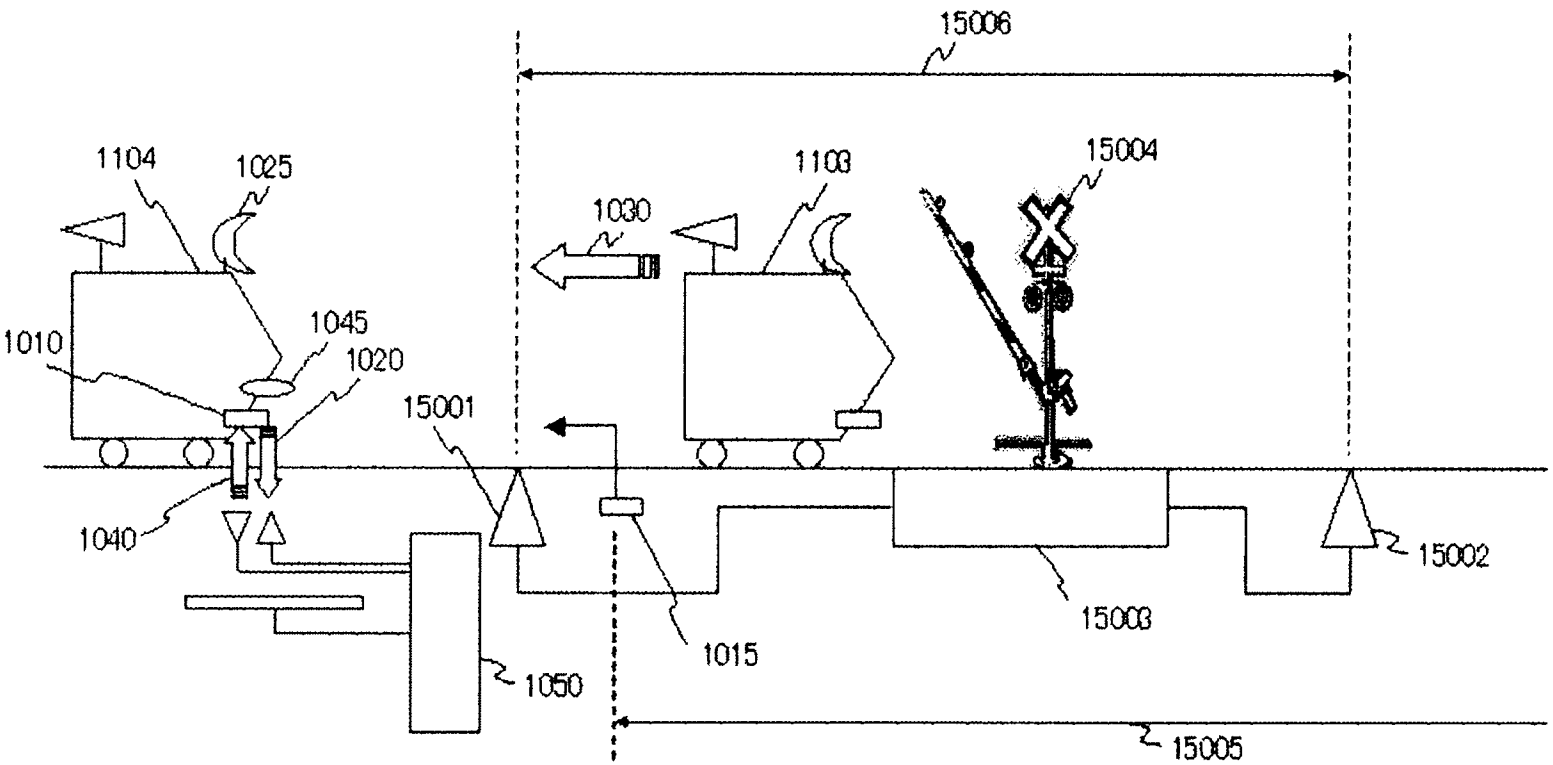
FIG. 13 is a schematic diagram illustrating a configuration of a train control system in Embodiment 3 according to the present invention.

FIG. 13 is a schematic diagram illustrating a configuration of a train control system in Embodiment 3 according to the present invention.

In FIG. 13, the train control system in Embodiment 3 includes a ground-based train-ID transmission/reception device 1050 that is a component in Embodiment 1 but placed instead at a location that is located a train braking distance or more before an entering location to a block section 15005 including at least a level or grade crossing 15004. It is not necessary to place the ground-based train-ID transmission/reception devices at the inter-station entering location and the inter-station leaving location as those in Embodiment 1.

The inter-train communications running continuation distance that is set by the route control device 1060 in Embodiment 1, is fixed up to a further front location of a leaving location from the block section 15005 including at least a grade crossing, and is stored in the ground-based train-ID transmission/reception device 1050. For other components, the same applies thereto as those in Embodiment 1, and the same reference numerals and symbols designate the same items as those shown in FIG. 1; thus, their explanation is omitted.

The block section 15005 is a track section into which only one train is allowed to enter, and is set by the existing signal system 1200 such as an ATC. For example, when the preceding train 1103 is existing on the track in the block section 15005, the existing signal device 1015 placed at a block-section entering location transmits to the following train 1104 a transmission signal including the information for stopping before the entering location of the block section 15005.

A warning-start detection device 15001, a warning-end detection device 15002, a crossing control section 15006 that is a section from the warning-start detection device 15001 up to the warning-end detection device 15002, a crossing control device 15003, and the grade crossing 15004 are components included in a conventional crossing apparatus.

The warning-start detection device 15001 is a device for detecting a passing train that enters the crossing control section 15006. By detecting the passing of trains using the warning-start detection device 15001, the crossing control device 15003 counts up the number of trains in the crossing control section 15006. In addition, the crossing control device 15003 controls to close the grade crossing 15004 when the number of trains in the crossing control section 15006 is "1" or more.

The warning-end detection device 15002 is a device for detecting the passing train that leaves the crossing control section 15006. By detecting the passing of trains using the warning-end detection device 15002, the crossing control device 15003 counts down the number of trains in the crossing control section 15006. In addition, the crossing control device 15003 ends the control to close the grade crossing 15004 when the number of trains in the crossing control section 15006 becomes "0."

Figure 17:
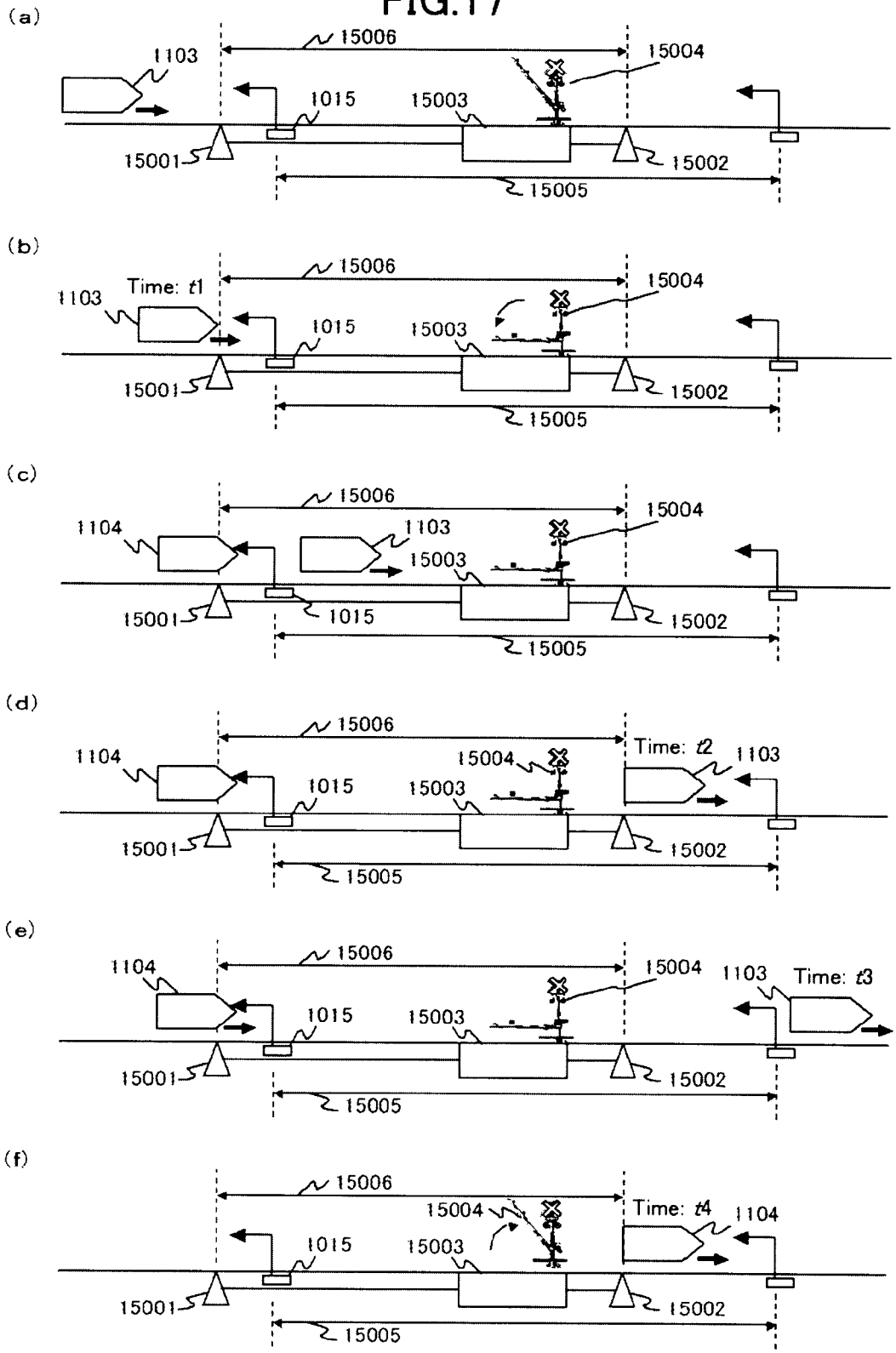
FIG. 17 is a schematic diagram for explaining an operation example of a crossing control device of the conventional train control system.

Here, an operation example of the conventional crossing apparatus will be described referring to FIG. 17, in a case where two trains are running close with each other. FIG. 17(*a*) illustrates a state in which the preceding train 1103 is approaching to the crossing control section 15006, and the crossing control device 15003 does not start the close control because the number of trains in the crossing control section 15006 is "0."

Next, in FIG. 17(*b*), the preceding train 1103 passes through above the warning-start detection device 15001, so that the crossing control device 15003 counts up the number of trains in the crossing control section 15006 to "1," and then starts the close control of the crossing. This time is given to t1.

Subsequently, in FIG. 17(*c*), the following train 1104 also passes through above the warning-start detection device 15001, so that the crossing control device 15003 counts up the number of trains in the crossing control section 15006 to "2," and continues controlling to close the crossing. Meanwhile, the following train 1104 stops at the entering location of the block section 15005 by a transmission signal by the existing signal system 1200.

Next, in FIG. 17(*d*), the preceding train 1103 passes through above the warning-end detection device 15002, so that the crossing control device 15003 counts down the number of trains in the crossing control section 15006 to "1," and continues controlling to close the crossing. This time is given to t2. Here, (t2−t1) is the time period in which one train runs through the crossing control section 15006, and this is denoted as a standard crossing close time T1.

Subsequently, in FIG. 17(*e*), the preceding train 1103 leaves the block section 15005 including the grade crossing 15004, so that the stopping control of the train 1104 is released by the transmission signal in the existing signal system 1200, and the following train 1104 starts running. This time is given to t3. Here, (t3−t2) is the time period after one train has passed through above the warning-end detection device 15002 until it leaves the block section 15005, and this is denoted as 72.

Lastly, in FIG. 17(*f*), the following train 1104 passes through above the warning-end detection device 15002, so that the crossing control device 15003 counts down the number of trains in the crossing control section 15006 to "0," and ends the close control of the crossing. This time is given to t4.

Here, presuming that the time period after the following train 1104 starts its running from its stopping state before the block section 15005 until it passes through above the warning-end detection device 15002 is approximately equal to the standard crossing close time T1, the continuation time for close control until the two trains pass through can be given as the following equation.

$$\text{Continuation time period for close control of the crossing} \approx 2*T1+T2$$

Figure 14:
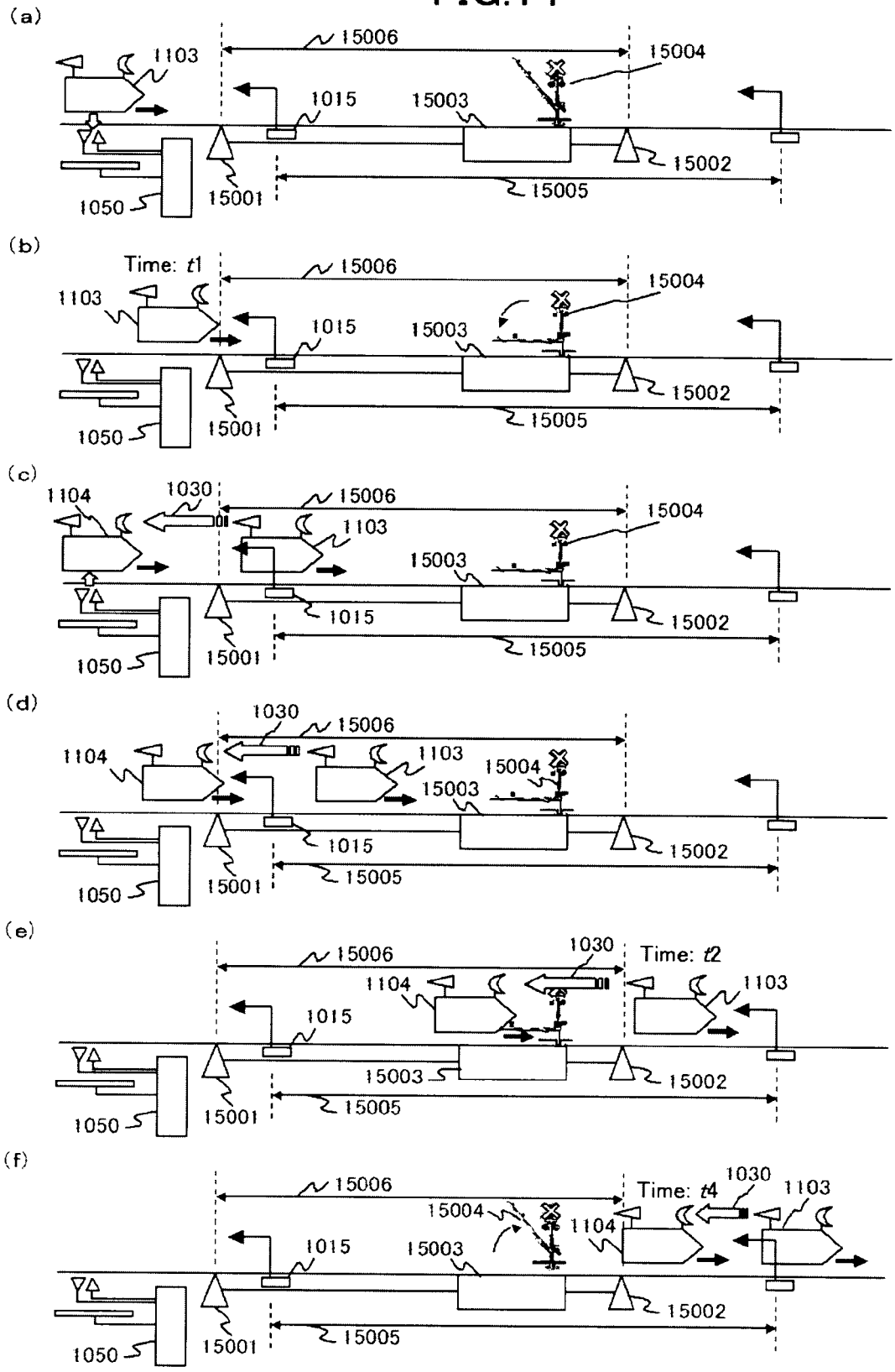
FIG. 14 is a schematic diagram for explaining an operation example of a crossing control device of the train control system in Embodiment 3 according to the present invention.

Next, a control flow of the crossing in Embodiment 3 according to the present invention will be described referring to FIG. 14. FIG. 14(*a*) illustrates a state in which the preceding train 1103 toward the crossing control section 15006 has passed through on the ground-based train-ID transmission/reception device 1050 placed at a location that is located the train braking distance or more before the entering location to the block section 15005 including the grade crossing 15004, where an ID of the preceding train 1103 is transmitted and registered in the ground-based train-ID transmission/reception device 1050.

Subsequently, in FIG. 14(*b*), the preceding train 1103 passes through above the warning-start detection device 15001, so that the crossing control device 15003 counts up the number of trains in the crossing control section 15006 to "1," and starts the close control of the crossing. This time coincides with t1 in FIG. 17(*b*).

Next, in FIG. 14(*c*), the following train 1104 passes through on the ground-based train-ID transmission/reception device 1050 and receives the train ID of the preceding train 1103, and in addition, receives the inter-train communications transmission signal 1030 from the preceding train 1103, thereby starting the train control based on the inter-train communications system 1201.

The following train 1104 can accurately distinguish whether or not the received signal information is from the actually preceding train, based on the received train ID of the preceding train 1103. When the following train 1104 receives an inter-train signal of a further front train, due to a malfunction or the like in the inter-train communications system 1201 of the preceding train 1103, a speed control is performed by the existing signal system 1200 after changing over from the inter-train communications system 1201 thereto. Accordingly, there is no such a case that the following train 1104 erroneously approaches the actually preceding train 1103 beyond an allowable range.

In addition, when the onboard train-ID transmission/reception device 1045 of the preceding train 1103 malfunctions, the preceding train 1103 does not have the onboard train-ID transmission/reception device, or so forth, the ground-based train-ID transmission/reception device 1050 can transmits to the following train the information indicative of a confirmation failure of the preceding train, so that the following train 1104 detects that there arises some kind of problem in the preceding train 1103.

When the following train 1104 detects that there arises some kind of problem in the preceding train 1103, the following train 1104 performs the running control by the existing signal system 1200 that controls trains without using the inter-train communications. Also in this case, there is no such a case that the following train 1104 erroneously approaches the preceding train 1103 beyond an allowable range.

Subsequently, in FIG. 14(*d*), the following train 1104 also passes through above the warning-start detection device 15001, so that the crossing control device 15003 counts up the number of trains in the crossing control section 15006 to "2," and continues controlling to close the crossing. The following train 1104 runs under its train control based on the inter-train communications system 1201 without stopping at the entering location of the block section 15005 including the grade crossing 15004.

Next, in FIG. 14(*e*), the preceding train 1103 passes through above the warning-end detection device 15002, so that the crossing control device 15003 counts down the number of trains in the crossing control section 15006 to "1," and continues controlling to close the crossing. Meanwhile, the following train 1104 runs in the block section 15005 including the grade crossing 15004, successively to the preceding train 1103, by the train control based on the inter-train communications system 1201. This time coincides with t2 in FIG. 17(*d*).

Lastly, in FIG. 14(*f*), the following train 1104 passes through above the warning-end detection device 15002, so that the crossing control device 15003 counts down the number of trains in the crossing control section 15006 to "0," and ends the close control of the crossing. Therefore, when a time period from the state in FIG. 14(*e*) until that in FIG. 14(*f*) is presumed as "α," a continuation time period for close control of the crossing until the two trains in Embodiment 3 pass through can be given as the following equation.

$$\text{Continuation time period for close control of the crossing} \cong T1+\alpha$$

As it can be understood from FIG. 14(*e*) and FIG. 14(*f*), in Embodiment 3, if the following train 1104 runs closely to the preceding train 1103 by the train control based on the inter-train communications system 1201, the period "α" becomes smaller than the standard crossing close time T1.

As described above, in Embodiment 3, when the two trains are running close with each other, they are allowed to run together through, using the train control based on the inter-train communications system 1201, the block section 15005 including the grade crossing 15004 by the train-ID transmission/reception system 1202 using the ground-based train-ID transmission/reception device 1050, so that the closing time of the crossing can be significantly shortened.

Moreover, without entirely modifying constituent devices of the conventional crossing apparatus, namely, the warning-start detection device 15001, the warning-end detection device 15002, the crossing control device 15003 and the grade crossing 15004, the closing time of the crossing can be significantly shortened.

What is claimed is:

1. A train control system, comprising:

a first control system that controls, based on a control signal from the ground side, running of a first train and a second train that runs following the first train;

a second control system that controls the running of the second train by an inter-train signal received from the first train including first identification information that distinguishes the first train; and a third control system that detects passing of the first train from the ground side, acquires train information including second identification information that distinguishes the first train, detects passing of the second train from the ground side, and transmits the train information to the second train, thereby controlling running of the second train utilizing either one of the first control system or the second control system by changing over therebetween based on the train information, wherein the third control system changes over to the first control system when the second identification information in the train information received by the second train differs from the first identification information of the inter-train signal.

2. A train control system, comprising:

a first control system that controls, based on a control signal from the ground side, running of a first train and a second train that runs following the first train;

a second control system that controls the running of the second train by an inter-train signal received from the first train; and a third control system that detects passing of the first train from the ground side, acquires train information of the first train, detects passing of the second train from the ground side, and transmits the train information to the second train, thereby controlling running of the second train utilizing either one of the first control system or the second control system by changing over therebetween based on the train information, wherein the third control system sets, as the train information, confirmation failure information when the train information cannot be acquired from the first train, and then changes over to the first control system when the second train acquires the train information including the confirmation failure information.

3. An onboard control device, comprising:

a first train control device that controls a train based on a control signal from the ground side;

a second train control device that controls running of the train by an inter-train signal received from a first train including first identification information that distinguishes the first train that runs directly in front of the train; and a third train control device that controls running of the train utilizing either one of the first train control device or the second train control device by changing over therebetween based on train information, received from the ground side including second identification information that distinguishes the first train, thereby controlling the trains by changing over to the first train control device, wherein when the second identification information in the train information received by the train differs from the first identification information of the inter-train signal, or when information indicative of a confirmation failure of the first train is received thereby.

4. The onboard control device as set forth in claim 3, wherein the inter-train signal includes the first identification information that distinguishes the first train and a trailing-end location of the first train.

5. The onboard control device as set forth in claim 3, wherein the first train control device includes an onboard Automatic Train Control (ATC) device.

6. The onboard control device as set forth in claim 3, wherein the second train control device includes:

an inter-train communications transmission device that transmits the inter-train signal to either one of a following train or an inter-train signal relay device; and an inter-train communications reception device that receives the inter-train signal from either one of a preceding train and the inter-train signal relay device.

7. The onboard control device as set forth in claim 3, wherein the third train control device includes an onboard transmission/reception device that transmits train information of the train to the ground side, and receives the train information of the first train from the ground side.

8. The onboard control device as set forth in claim 3, further comprising:

an onboard transmission/reception device that transmit train information of the train presuming as a first train, and receives the train information and a control-continuation distance serving as the second train; and an onboard memory unit that stores the train information and the control-continuation distance received by the onboard transmission/reception device, wherein the third train control device controls running of the trains by using the second train control device within the control-continuation distance based on the train information stored in the onboard memory unit, and by changing over to the first train control device beyond the control-continuation distance until next train information is being acquired.

* * * * *